United States Patent [19]

Glanz et al.

[11] 4,366,753

[45] Jan. 4, 1983

[54] CIRCUMFERENTIAL REGISTRATION CONTROL SYSTEM

[75] Inventors: Richard Glanz, Crystal Lake; Sun C. Chang, Naperville, both of Ill.

[73] Assignee: Baldwin Korthe Web Controls, Inc., Addison, Ill.

[21] Appl. No.: 139,507

[22] Filed: Apr. 11, 1980

[51] Int. Cl.[3] ..... B41F 5/06; B41F 5/16; G05B 19/29

[52] U.S. Cl. ..... 101/181; 318/603; 101/227

[58] Field of Search ..... 101/181, 227, 248, 178; 235/92 MP, 92 R, 92 PD, 92 T; 318/601, 602, 603; 250/561, 571; 226/2, 28-31, 34

[56] References Cited

U.S. PATENT DOCUMENTS

| | | | |
|---|---|---|---|
| 3,594,552 | 7/1971 | Adamson . | |
| 3,601,587 | 8/1971 | Thiede | 226/28 |
| 3,624,359 | 11/1971 | Roote . | |
| 3,813,524 | 5/1974 | Coberley . | |
| 3,870,936 | 3/1975 | Coberley | 318/603 X |
| 3,898,645 | 8/1975 | Coberley . | |
| 3,914,582 | 10/1975 | Coberley . | |
| 3,919,561 | 11/1975 | Coberley . | |
| 3,949,282 | 4/1976 | Coberley . | |
| 4,135,664 | 1/1979 | Resh . | |
| 4,147,104 | 4/1979 | Zernov et al. | 101/181 |
| 4,243,925 | 1/1981 | Gnuechtel | 318/603 |

FOREIGN PATENT DOCUMENTS 1102876 3/1961 Fed. Rep. of Germany .

*Primary Examiner*—J. Reed Fisher

*Attorney, Agent, or Firm*—Neuman, Williams, Anderson & Olson

[57] ABSTRACT

A system for controlling registration in a Printing press between the moving web having repetitive print patterns and a work station operated cyclically in synchronization with the press. The system includes a photoelectric scanner having a variable sensitivity, a position pulse generator with a backup accumulating device, a motorized compensator for controlling the longitudinal position of the web relative to the work station and a digital control circuit for driving the compensator to correct misregistration. The control system counts position pulses during each cycle of the work station, defines a monitoring period during which marks and repetitive print patterns are scanned and signals differences between the cycles of the print markings and the work station by sampling at the occurrence of each mark, a digital number which corresponds to the instantaneous position of the work station and its cycle. To enhance selectivity the system employs a variable sensitivity scanner, a variable duration window or monitoring period and automatic setup apparatus that synchronizes the system to those portions of the web which are most distinctive and uncluttered. Many other features and options are described.

11 Claims, 10 Drawing Figures

CIRCUMFERENTIAL REGISTRATION CONTROL SYSTEM

BACKGROUND OF THE INVENTION

The present invention relates generally to registration control systems used for printing presses and in particular to registration control systems operating on photoelectric principles.

It is important in virtually all printing applications to maintain registration between various print stations which might apply different colors, sizes or types of print as well as between print stations and other controls such as folding devices or page cutoff shears. Minute errors in registration can cause blurred images, ghosts, page displacement and other unacceptable printing conditions. While the various press work stations, such as printers, dryers, folding devices and cutting shears generally operate in close synchronism with each other by virtue of their common drive system, the longitudinal position of the web itself may vary with slippage, slackening and various environmental factors, such as humidity and temperature, that may cause shrinkage or stretching of the web.

Therefore, numerous systems have been devised for controlling the longitudinal registration between a moving web and the various work stations of a printing press. Several of these known registration systems employ scanning devices for comparing repetitively occurring marks printed on the web to the position of various work stations in their operating cycle. The work station drive mechanism is often used as a reference for this comparison, and to this end, various devices have been used to generate a "window" or monitoring period in each cycle of the work station during which the web is optically scanned for registration marks and position errors generated. A common method for generating this window is through the use of various press driven discs having apertures which are photoelectrically or magnetically detectable to define the window area. In systems of this type, however, the observation window is generally fixed relative to the cyclical position of the work station, such as a web shearing drum, and the web markings must be carefully positioned to coincide with the observation window during initial setup of the press. Still other systems employ shaft encoders and devices to index the encoder to the cycles of the work station. These systems also have entailed a difficult setup procedure and require a careful initial positioning of the web scanning devices either manually or through expensive and complicated automatic controls.

More important, the systems heretofore known in the art are generally somewhat inflexible in their ability to synchronize or lock onto a given mark in the print pattern on the web and they often require that the mark be distinctive and totally separated from other portions of the print pattern. As such, they present varying degrees of difficulty during initial setup that have to be accommodated. Many of these systems are analog in nature and, as such, are inherently limited in their ability to distinguish between marks of varying intensity on a given print pattern. Their use is limited accordingly.

SUMMARY OF THE INVENTION

The present invention provides several advantages over the registration control systems heretofore known in the art in that it is an all digital system employing several features which greatly simplify the setup and operation of the system while providing enhanced sensitivity and discrimination. Due to its digital nature, the system is inherently accurate and reliable. At the same time the system operates smoothly by providing a proportional speed control to the compensator drive system during most registration errors.

These advantages are obtained and the drawbacks of the existing systems are largely overcome through the provision of a registration system which provides a large number of individual position pulses, typically 10,000 during each cycle of the work station, to serve as a basis for comparison during the monitoring of marks on the web by a photoelectric web scanner. The position pulses are continuously fed to a primary counter which generates its full count in synchronism with the repetitive cycles of the work station. Predetermined counts registered in the primary counter trigger the opening and closing of an observation period or "window" during which a secondary counter is operated to register a number indicating the proximity of the count in the primary counter to the reset point at the end of the primary counter cycle. Upon the occurrence of a mark on the web within the observation window the condition of the secondary counter is sampled to develop an error signal which is proportional in sense and magnitude to the actual registration error between the print patterns and the work station. This error signal is applied to a web compensating motor through a proportional motor control drive system. During setup the system automatically selects a marking on the print text which is separated from and easily discriminated from other markings on the text as a principle reference for repetitive cycling. In addition, the system includes means for inhibiting operation of the correcting motor during slowdown of the web due to system shutdown. There is a further provision allowing the operator to deactivate the automatic control system and to manually adjust the web position longitudinally through the compensator motor mechanism. In the alternative, the operator may change the relationship between the reference marks and the work station electronically during normal operation of the press in instances where an actual change in the registration condition is desired. A continuous display of both the sense and magnitude of the position error is provided on the control panel of the system to allow the operator to precisely monitor the registration of the system at any time.

These and other objects and advantages of the invention will become apparent upon reading the following detailed description and the appended claims, and upon reference to the accompanying drawings.

While the invention will be described in connection with certain preferred embodiments, it will be understood that we do not intend to limit the invention to those embodiments. On the contrary, we intend to cover all alternatives, modifications and equivalents as may be included within the spirit and scope of the invention as defined by the appended claims.

DESCRIPTION OF THE PREFERRED EMBODIMENT

Figure 1:
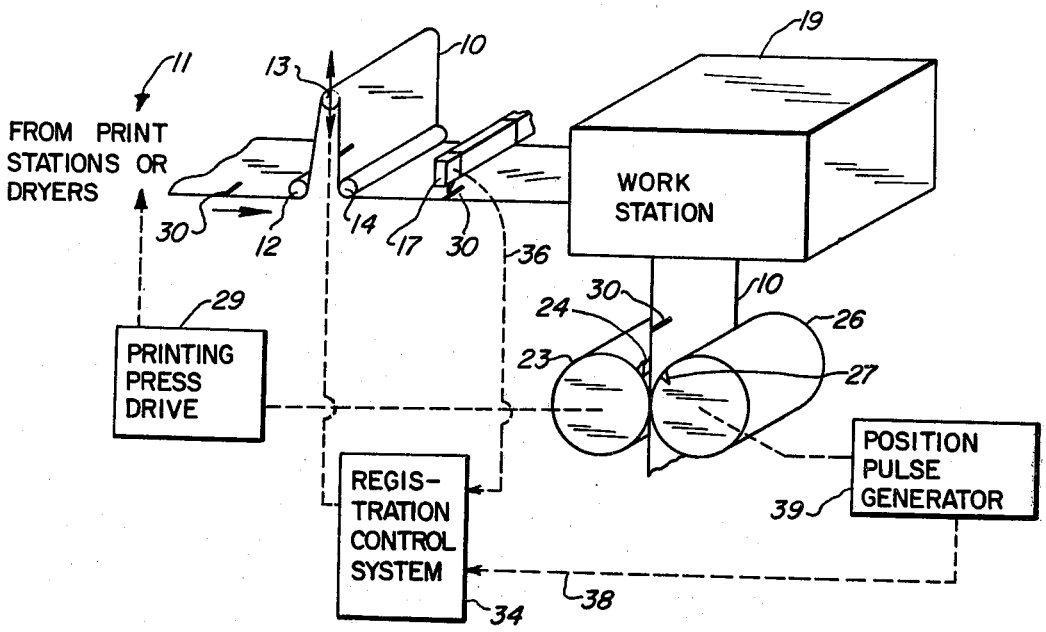
FIG. 1 is a diagram illustrating the registration control system of the present invention operating in conjunction with typical printing press components.

Turning first to FIG. 1, the system is depicted as controlling a moving web 10 passing from various print stations or dryers 11 to a web compensating mechanism consisting of rollers 12, 13 and 14. While a linear mechanism is depicted any of a variety of web shifting devices, including so called "swing type" compensators, may be employed for longitudinal adjustment of web position. The center roller 13 moves up and down relative to the rollers 12 and 14 via a compensating motor (not shown) to control the longitudinal position of the web relative to subsequent work stations. From the compensating rollers 12, 13 and 14, the web passes under a photoelectric scanner 16 which is provided for monitoring the occurrence of preprinted registration marks or other changes in contrast on the moving web 10 passing under the scanner. The scanner generally includes an optical transceiver portion 17 positioned along one edge of the path for the web 10. Various additional work stations may be provided as depicted generally at 19. These other work stations may include, for example, various devices for folding the web 10 upon itself, sheeting the web 10, or additional print station for impressing various portions of the print pattern upon the web.

From the work station 19 the web is depicted as passing through another work station consisting of a first drum 23 having a cutting blade 24 extending longitudinally along its outer surface. The first drum 23 cooperates with a second drum 26 having a receptacle 27 extending longitudinally along its outer surface. The drums 23 and 26 operate in unison under the control of a printing press drive unit 29, the cutting blade 24 being cyclically driven into engagement with the longitudinal receptacle 27 for severing the web 10 at selected intervals. The printed press drive unit 29 may take any of a variety of different forms depending upon the nature of the application. In general, however, the drive unit 29 maintains operation of the various components and work stations of the printing press in synchronism with each other. Further in accord with the principles of synchronism in printing presses, the cutting drums 23 and 26 have a circumference corresponding to an integer multiple of the repeat length of the moving web 10. In the present instance, that integer multiple is 1, but it will be understood that additional shearing bars such as the shearing blade 24 could be provided equidistant around the circumference of the drum 23 with corresponding notches in the drum 26 to allow multiple cuts to be made in the web 10 during each revolution of the cutting drum 23. Similarly, it will be appreciated that the web 10 may have multiple recurring print patterns impressed thereon between successive ones of the registration marks 30. In such an application, the cutting drums 23, 26 serve to make an initial cut of the web 10 into multi-page sheets, with further cutting of the sheets being left to other equipment.

While the registration marks 30 are shown as distinctive black marks on the web 10 in FIG. 1, it will be appreciated from the description below that the system is capable of synchronizing to webs on which registration marks are not present. The system can, for example, synchronize itself to changes in color or other forms of contrast change within the copy by appropriate adjustment of system sensitivity.

In accordance with the present invention, the press components of FIG. 1 include a registration control system 34 having an input 36 for receiving the output signal from the photoelectric scanner 17 and an input 38 for receiving an output signal from a position pulse generator 39. The position pulse generator 39 is provided for the purpose of generating a plurality of pulses in a train, each corresponding to an incremental movement of the press drive mechanism. In the embodiment of FIG. 1 the position pulse generator 39 may be a part or all of a shaft encoder driven in synchronism with and by the shaft of the drum 26. The pulse generator 39 typically includes a photoelectric pickup device for monitoring the position of a marked or apertured disc on the end of the drum 26. In the detailed embodiment to be described below, the pulse generator 39 is adapted to generate 10,000 pulses during each revolution of the cylinder 26 and the corresponding cutting cylinder 23. For this application a shaft encoder model H25D manufactured by BEI Electronics Incorporated has proven suitable for the encoder portion of the pulse generator 39. The registration control system 34 provides an output 43 generally in the form of a mechanical drive to adjust the position of the center roller 13 of the compensating rollers 12, 13 and 14 so as to accumulate more or less paper in the compensating unit, as desired, and thus to adjust the longitudinal position of the web relative to the work stations of the press.

While the system will be generally described for printing in paper presses, it will be appreciated that the invention is readily applicable to other web applications wherein the web may be materials other than paper, such as cloth, synthetic material or sheet metal.

Figure 3:
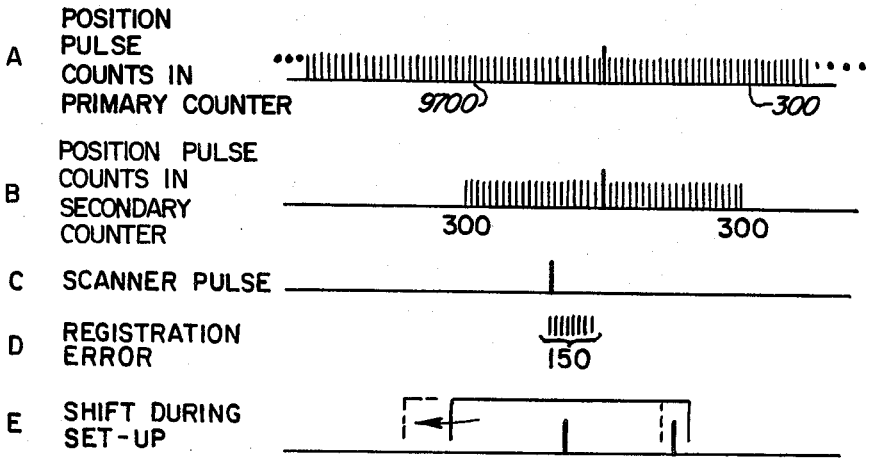
FIG. 3 is a timing diagram illustrating the principles of operation of various aspects of the present invention.
Figure 2:
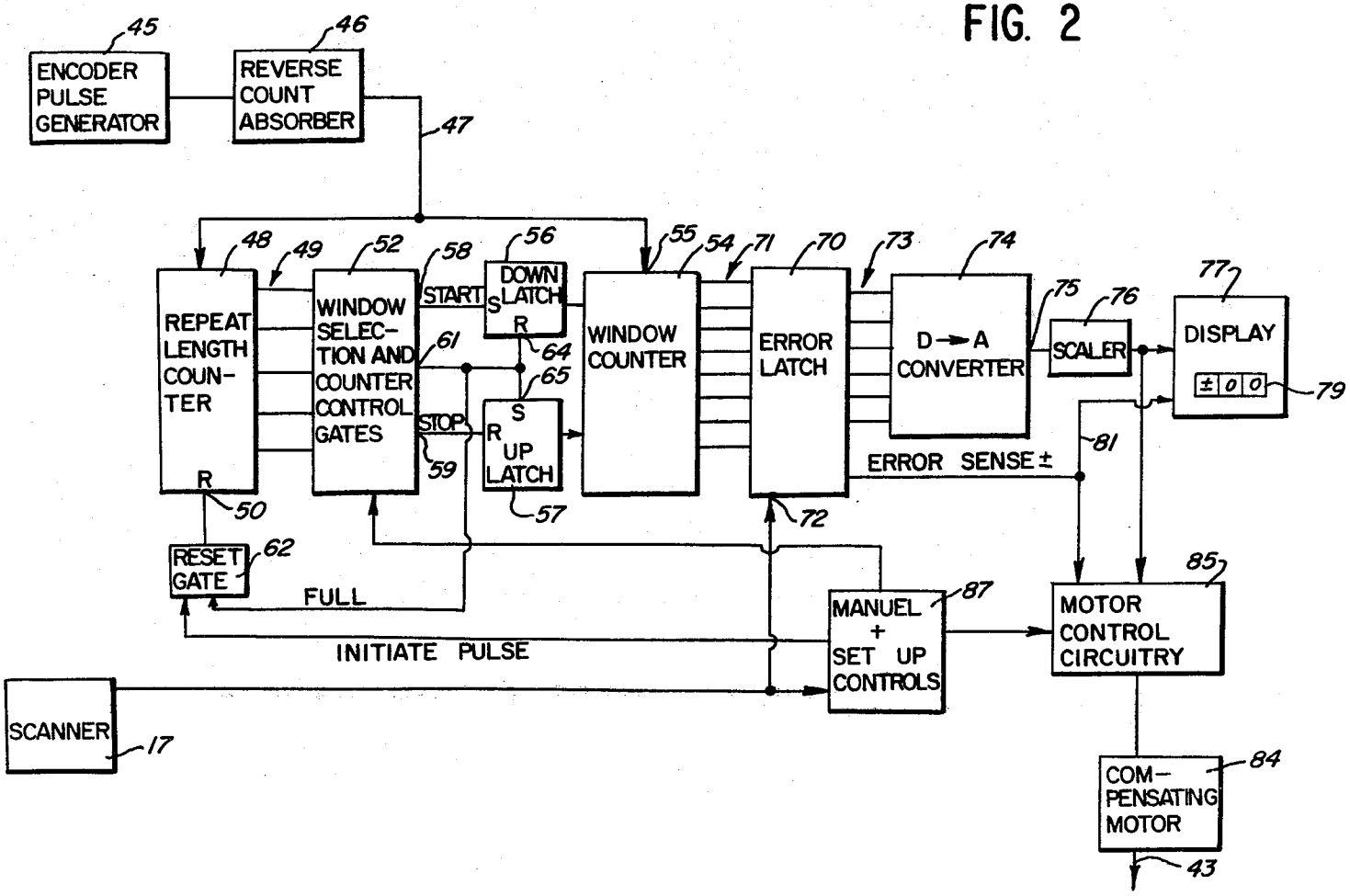
FIG. 2 is a simplified block diagram of the digital control system illustrating the basic control loop for the registration control system of the present invention.

While a detailed schematic of the registration control system is shown in FIGS. 5A–5F, the general method and apparatus incorporated in the control system is depicted in the block diagram of FIG. 2 and timing diagram of FIG. 3. Referring first to the method employed in the present invention illustrated in FIG. 3, it is seen that the system generates a continuous train of position pulses, each corresponding to a predetermined increment of the operating cycle of the work station. A portion of this pulse train is shown as signal A in FIG. 3. These position pulses, produced by the position pulse generator 39, are continuous in nature and depend in number and frequency on the type of pulse generator employed. For the embodiment described below, the pulse generator 39 produces 10,000 position pulses during each operating cycle of the work station, which in the case of the shearing station shown in FIG. 1 corresponds to one revolution of the cutting rollers 23 and 26.

The position pulses are then counted in repetitive cycles in a primary counter having a radix or capacity corresponding to the number of position pulses occurring during each cycle of the work station. For the embodiment described, the counter capacity therefore is 10,000. The system utilizes the primary counter to define a web monitoring period or "window" by detecting the achievement of a first predetermined count toward the end of each cycle to initiate the period and by detecting the achievement of a second predetermined count during the next cycle of the primary counter to terminate the monitoring period. This is illustrated by signal B of FIG. 3, wherein a period or window of 600 position pulses is shown spaced symmetrically about the end of the primary counter cycle designated 0. In this instance the monitoring window corresponds in length to ±3% of the operating cycle of the shearing station. The first predetermined count detected is 9700 while the second predetermined count detected is 0300. During this web monitoring period or window a second counter also monitors the position pulses and registers the count of the position pulses relative to the end of the count cycle in both directions from the reset point designated 0. For the example shown, this secondary counter begins operation at count 9700 of the primary counter and counts down from 300 to 0 while the primary counter continues to register counts to 10,000. Upon resetting of the primary counter to count 0000 the secondary counter stops counting down and begins counting up until count number 0300 is detected in the primary counter. Upon detection of the latter event, the monitoring period ends and the secondary counter assumes a quiescent condition. During the monitoring period, the web is being scanned for registration marks applied by the printing press in advance of the web scanner. These marks, commonly used in the art, are imposed on the web at equal points in successively occurring print patterns, although textual material could also be used as a registration indicator when desired.

As will be described more fully below, means are provided for initially synchronizing the primary and secondary counters to the occurrence of registration marks so that successive marks can be expected to pass the scanner during the monitoring period with a reasonable amount of certainty. Ideally, the successive registration marks will be detected at the exact center of the registration window, and any deviation between the mark and the center of that window will represent a registration error. In the example shown in FIG. 3 curve C represents a registration mark occurring 150 pulses prior to the center of the window. The count in the secondary counter at this instance, of course, is −150 (Curve D), the sign (−) being indicated by the fact that the secondary counter is counting down. This count is stored, manifested to the operator and utilized to adjust the longitudinal position of the web relative to the work station in an effort to reduce the registration error towards 0. It will be appreciated that for a 10,000 pulse repetitive count cycle, an error of 150 counts represents a registration error of 1.5%. This is converted through scaling to a direct indication of registration error in inches or millimeters.

The apparatus for implementing the foregoing scheme is shown generally in the block diagram of FIG. 2 and more specifically in the schematic of FIGS. 5A–5F. Referring first to FIG. 2, pulses corresponding to incremental changes in position of the work station in the forward direction are provided by an encoder 45 operating in conjunction with a reverse count absorber 46. The reverse count absorber 46 is provided for the purpose of inhibiting the passage of position pulses that result from temporary stuttering or backups of the web press drive. Since it is necessary to have the number of position pulses in the primary counter correspond precisely to one forward cycle of the work station, the reverse count absorber 46 registers the number of pulses generated by the encoder 45 during movement of the work station in the reverse direction, inhibits the generation of position pulses during movement in this direction and further inhibits a corresponding number of position pulses generated by the encoder 45 as the work station again moves forward in its cycle during catch up. For cyclically registering the count of the position pulses passed by the reverse count absorber 46, there is provided a primary counter 48 depicted in FIG. 2 as a REPEAT LENGTH COUNTER having a plurality of output lines 49 which provide a parallel representation of the instantaneous count of position pulses during the counting cycle. The counter 48 further has a reset input 50 for accepting a pulse to reset the counter at the end of its count cycle and to facilitate synchronization during startup.

Since the position pulses are generated continuously on the line 47 without regard to the actual completion time of the work station cycle, a plurality of window selection and control gates 52 are provided for initiating and terminating the web monitoring period and for controlling the cycle of the primary counter 48. These gates detect the achievement of various counts within the primary counter 48 to control the operation of a secondary counter 54. The counter 54 receives the position pulses at an input 55 and counts those pulses during periods established by either of a pair of latch circuits 56 and 57 which are operative to effect counting down and up respectively. The DOWN LATCH circuit 56 is activated by a signal from an output 58 from the counter control gates 52 which occurs upon the achievement of a first predetermined count by the counter 48. The UP LATCH circuit 57 is deactivated by a signal from an output 59 of the counter control gates 52 upon the achievement of a second predetermined count from the counter 48, the first and second predetermined counts defining the beginning and ends of the monitoring window as discussed above. A third signal is provided at an output 61 from the counter control gates 52 upon the achievement of the full count of the primary counter 48 indicating a completion of the primary count cycle. This signal is fed back to the reset input 50 of the counter 48 via a gate circuit 62.

Referring to the example illustrated in FIG. 3, the 10,000 position pulses on the line 47 are registered in the primary counter 48. For a 3% window, the counter control gates 52 are chosen so as to activate the output 58 when count 9700 is registered by the primary counter 48. This in turn activates the DOWN LATCH circuit 56 which directs the window counter 54 to begin counting down from the number 0300 toward zero to define the first half of the monitoring window. The detection of a full count in the primary counter 48 by the control gates 52 activates the output 61. This in turn resets the DOWN LATCH circuit 56 via an input 64 thereto and activates the UP LATCH circuit 57 via an input terminal 65 thereof. Activation of the UP LATCH circuit 57 directs the counter 54 to begin counting up from zero. At the same time, the output 61 of the gates 52 resets the primary counter 48 so that counting up by the primary and secondary counters 48 and 54 begin simultaneously. Eventually the counter control gates 52 detect the achievement of count number 0300 by the primary counter 48 and produce a signal on the output 59 to reset the UP LATCH circuit 57 and thereby deactivate the secondary or window counter 54 to terminate the monitoring period.

In order to detect and store the counts registered in the secondary counter 54 upon the occurrence of a scanner pulse during the monitoring window there is provided an error latch circuit 70. The latch circuit 70 samples the binary contents of the counter 54 appearing on a plurality of parallel output lines 71 upon the production of an output pulse by the scanner 17, the scanner pulse being applied to the latch circuit 70 via a sampling input 72 thereto. The error latch circuit 70 acts as a sample and hold circuit and provides a binary coded decimal output on a plurality of lines 73 indicative of the instantaneous registration error.

To facilitate utilization of the registration error appearing on the output lines 73, a digital-to-analog (D to A) converter 74 converts the error number in the latch circuit 70 to an analog voltage at an output terminal 75 which, in turn, is fed to a scaler circuit 76. The scaler circuit 76 operates in conjunction with a display module 77 to alert the operator of the recurring registration errors on a continuous basis, the display being updated with each cycle of the primary counter 48. The scaler circuit 76 allows the readout 79 of the display module to be calibrated to either inches or milimeters as desired. The sense of the error, i.e., wherether it is positive or negative, is detected by means to be described below and a signal indicative thereof is shown generally as being provided on a line 81 in FIG. 2. This signal is fed to the display 79 for manifestation to the operator.

In order that the registration error may be utilized to correct registration in a closed loop control system, a compensating motor 84 is provided to drive the compensating roller 13 (FIG. 1). The compensating motor in turn is controlled in direction and speed by motor control circuitry 85 which is responsive to the registration error via the D to A converter 74 and scaler circuit 76. To control the direction of compensation, the error sense signal provided on the line 81 is also fed to the motor control circuitry 85.

THE SYSTEM CONTROL PANEL

Figure 4:
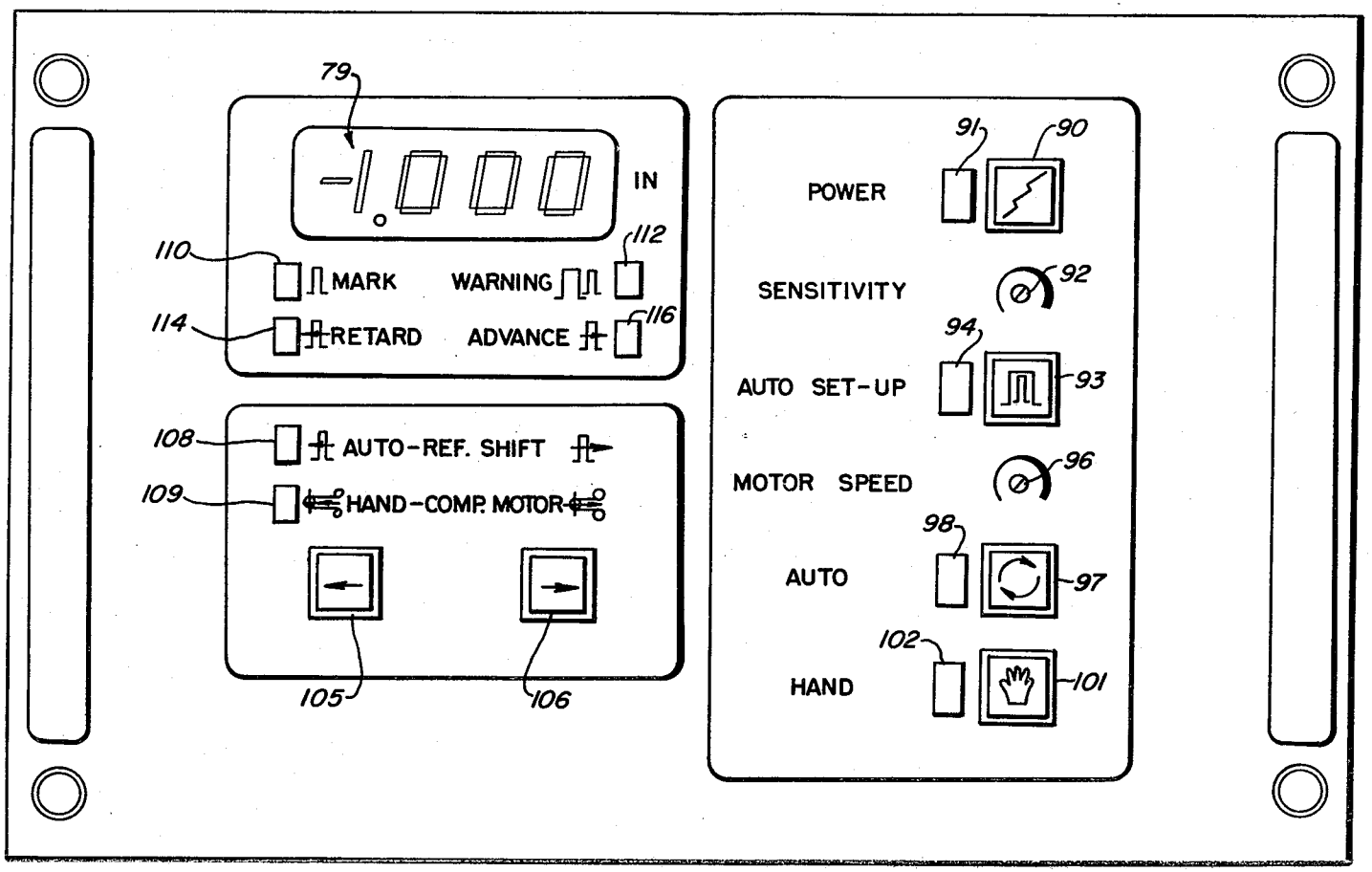
FIG. 4 is a view of the control panel for the registration control system of the present invention.

The system described thus far is manually set up and synchronized to the occurrence of registration marks on the web 10 through a plurality of circuits 87 designated generally as the MANUAL and SETUP CONTROLS in FIG. 2. These controls respond to various manual inputs on the control panel (FIG. 4). Turning then to FIG. 4, the control panel is seen to include a plurality of mode control switches. Among these are a pushbutton 90 for controlling the application of power to the system as indicated by an indicator lamp 91. Sensitivity of the scanner head is controlled by a screwdriver adjustment 92 in a manner to be described below. Push-button 93 initiates the AUTO SETUP mode, the operation of which is signaled by illumination of an indicator 94. The speed of the correction motor is manually adjustable by a screwdriver control 96. Upon completion of the AUTO SETUP mode, the system is triggered to the AUTO mode, the occurrence of which is signaled by an AUTO indicator 98. Finally, the system may at any time be transferred to a manual or HAND mode by actuation of a pushbutton 101. An indicator 102 is illuminated during the manual mode.

For manually controlling the position of the compensating motor during the manual mode there is provided a pair of pushbuttons 105 and 106 for respectively retarding or advancing the compensating motor. As will also be described further below, the pushbuttons 105 and 106 may also be used during the AUTO mode for shifting the reference point for the system as will be indicated by illumination of an indicator 108. During the manual mode a further indicator 109 will be lit to alert the operator that pushbuttons 105 and 106 may be actuated.

For the purpose of displaying the registration error, the instrument panel further includes the visual display 79. A plurality of indicator lights under the visual display signal various conditions. For example, a first indicator 110 designated MARK flashes upon passage of every second registration pulse under the scanner. A second indicator 112 designated WARNING alerts the operator whenever the scanner is not reading the mark within the window period. Finally, a pair of indicators 114, 116 respectively designated RETARD and ADVANCE alert the operator as to the direction in which the compensating motor is moving at any given time. The response of the system to these controls will be more fully discussed in connection with FIGS. 5A–5F described below.

The reference numerals in the detailed system schematic of FIGS. 5A–5F will in many cases be the same as those in FIGS. 1, 2 and 4 where the same components are illustrated more generally.

THE AUTOMATIC CONTROL LOOP CIRCUITS

Figure 5A:
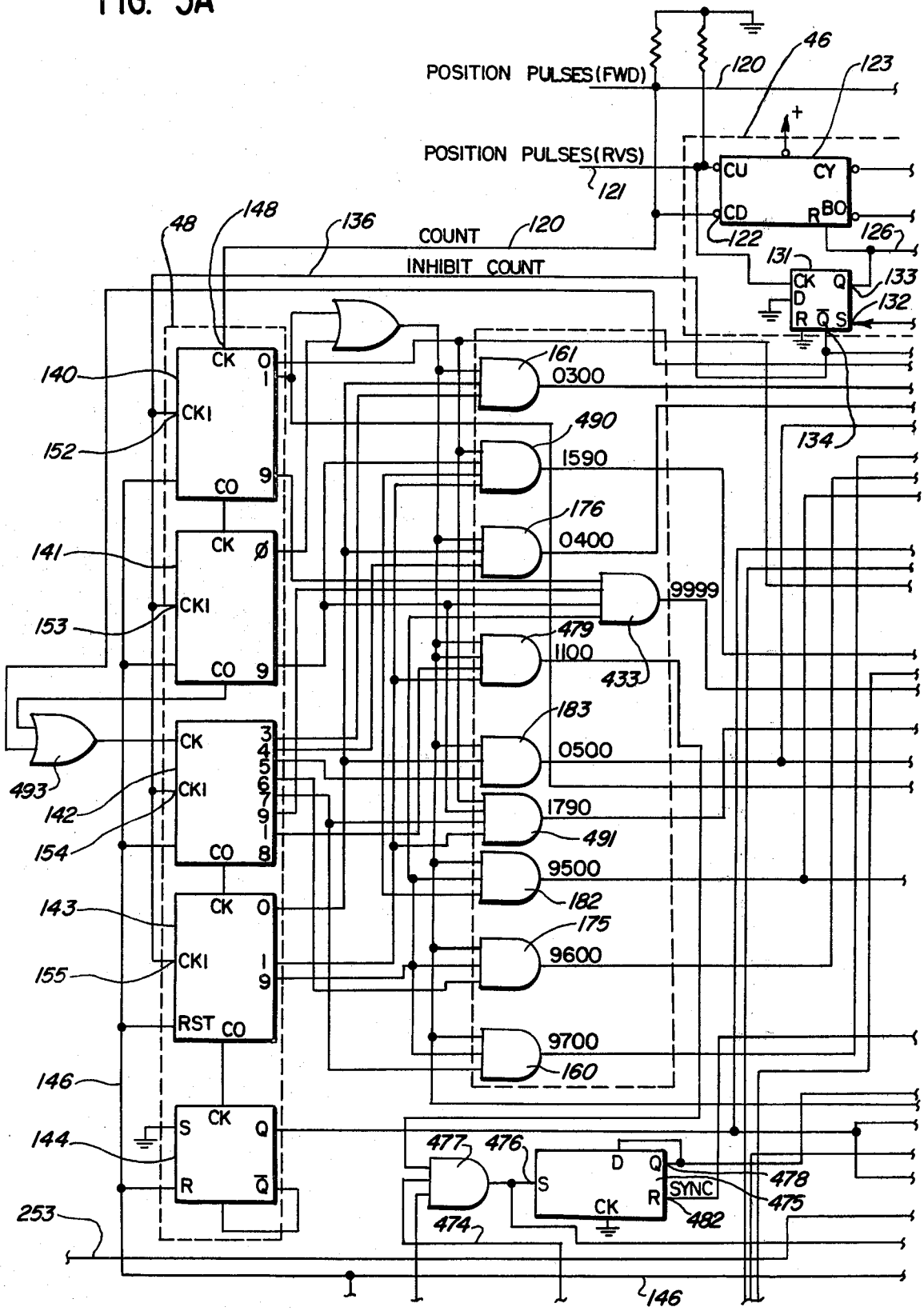
FIGS. 5A-5F are a detailed circuit schematic illustrating the preferred embodiment for the control system of the present invention shown generally in FIG. 2. The relationship of these figures A–F to each other is depicted in the explanatory diagram at the top of FIG. 5F. Together these figures constitute a single schematic.
Figure 5B:
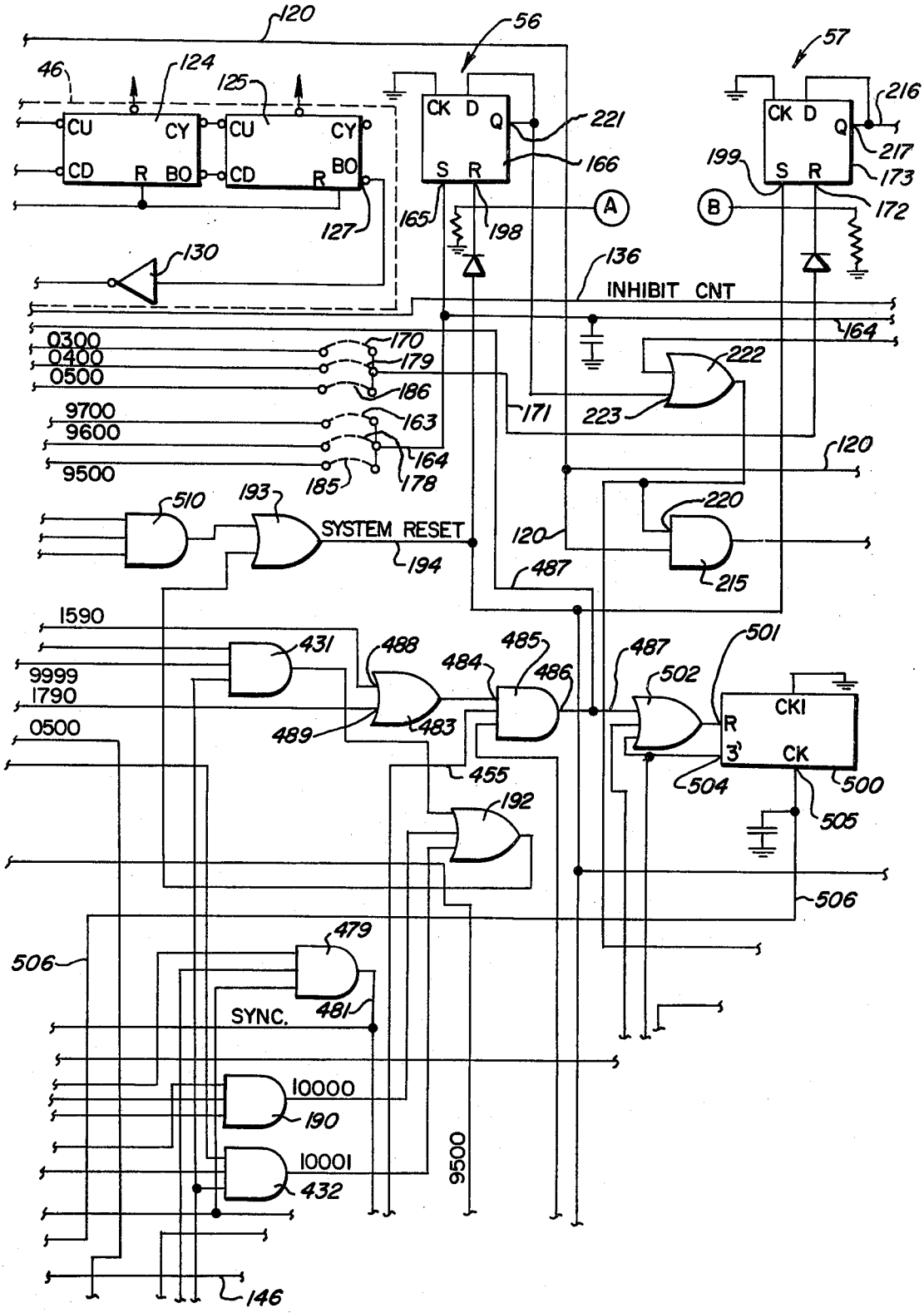
Figure 5C:
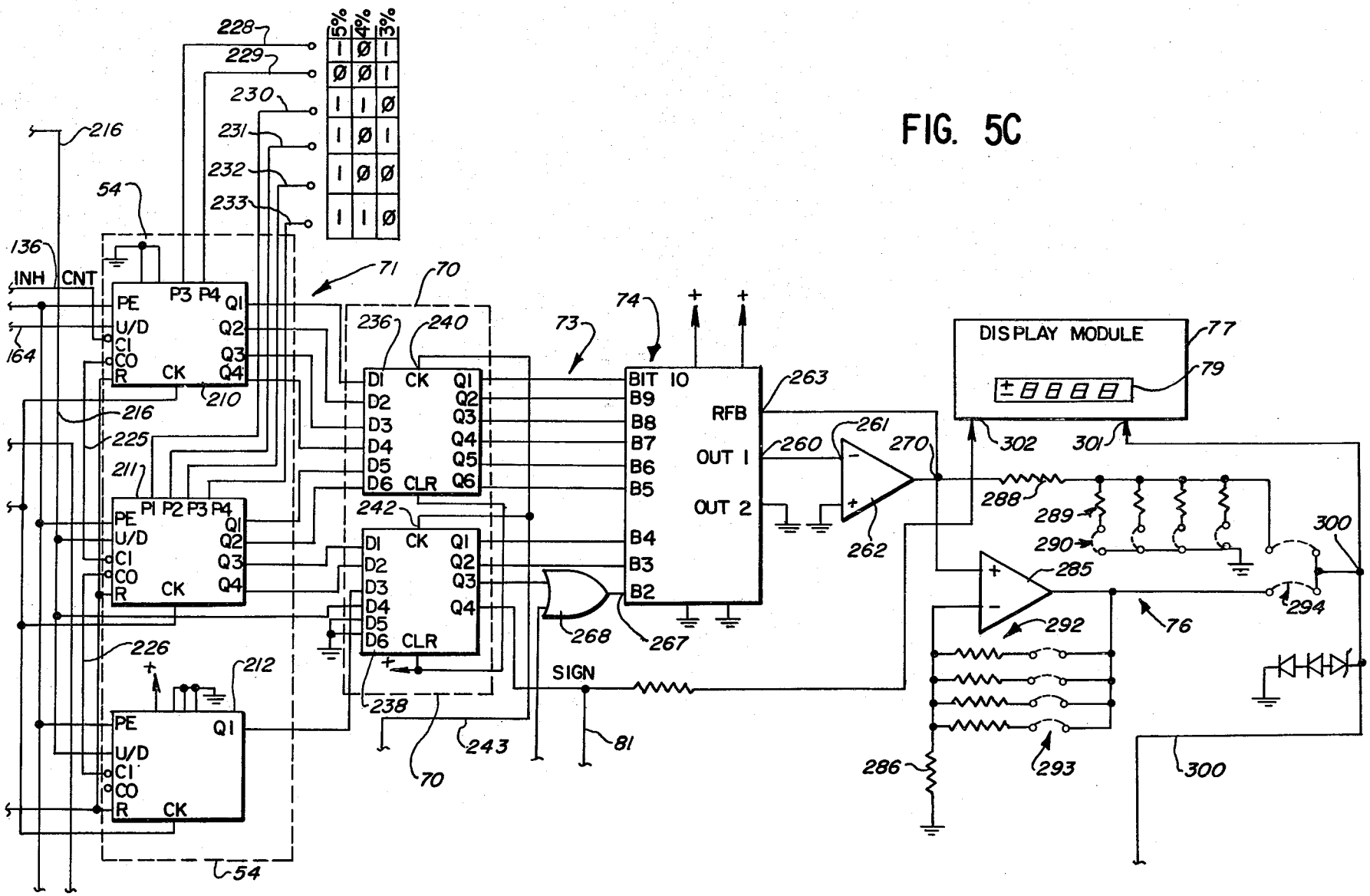

FIGS. 5A and 5B illustrate the reverse count absorber circuit 46, the primary counter 48 and the window selection and counter control gates 52. Turning first to the reverse count absorber 46, pulses generated by the position pulse generator during forward movement of the work station are fed to the circuit 46 via an input line 120 while pulses generated by the position pulse generator during reverse movement of the work station are produced on an input line 121. The absorber circuit includes an up-down counter consisting of three decade counting stages 123, 124 and 125 connected in tandem as shown and having a common reset line 126. An output terminal 127 from the third stage is activated whenever the count returns to 0. This terminal is coupled to an inverter gate 130 which in turn operates to set a flip-flop 131 via an input terminal 132 thereof. The Q output 133 of the flip-flop 131 controls the reset line 126, while the $\overline{Q}$ output 134 is connected to a line 136 designated INHIBIT COUNT. The INHIBIT COUNT line 136, when activated, inhibits counting in both the primary counter 48 and the secondary counter 54 (FIG. 5C). In operation, whenever the press drive moves in the reverse direction, pulses are generated on the input line 121 which cause the counter circuits 123, 124 and 125 to begin counting up from 0. Simultaneously, the flip-flop 131 is reset to enable the INHIBIT COUNT line 136 via the $\overline{Q}$ output 134. When the reverse movement of the press stops and forward movement begins, pulses no longer occur on the line 121 but instead begin occurring on the line 120. The pulses on the line 120, designated the COUNT line, are applied to the counter stages 123, 124 and 125 at an input 122 which causes counting down of the counter. The flip-flop circuit 131 remains in its reset condition, inhibiting the primary and secondary counters 48, 54, until the count in the counter stages 123, 124 and 125 returns to 0, signifying that the press has caught up after its momentary reverse operation. This results in an output signal at the terminal 127 of the third stage 125 of the absorber circuit which, after inversion in the inverter 130, toggles the flip-flop 131 and deactivates the INHIBIT COUNT line 136.

Thereafter the primary and secondary counters 48 and 54 operate in a normal manner.

The primary counter 48 consists of 4 decade counter units 140, 141, 142, 143 and a single count register 144. These units are connected in tandem to constitute a pulse counter, registering respectively, 1's, 10's, 100's, 1,000's and 10,000's. The units 140–144 are reset by a pulse on a common reset line 146. The forward position pulses from the decoder appearing on line 120 are applied to a clock input 148 of the first counting unit 140 to drive the primary counter 48, the clock inputs of each of the subsequent stages 141–144 being driven from the carry over outputs (CO) of the previous stage in the manner well known in the art. Each of the decade units 140–143 further has an input, designated 152, 153, 154 and 155 respectively, which are connected to the inhibit count line 136 to effect total stoppage of the counter 48 during activation of the line 136. The counts being monitored on each of the decade units 140–143 are indicated on the right and within each unit on FIG. 5A.

Turning now to the window selection and counter control gates 52, it will be recalled that the system defines the window for monitoring registration marks on the web by detecting the achievement of certain predetermined counts in the primary counter 48. Moreover, the window may be varied in width by the user of this system so as to be either ±3%, ±4% or ±5%. To effect a window of ±3%, the window control gates 52 includes an AND gate 160 for detecting the achievement of count number 9700 by the counter 48 and an AND gate 161 for detecting the achievement of the count 0300 in the counter 48. The output of the gate 160 is selectively applied through a jumper connection 163 to a common input line 164 which controls the S input 165 of a flip-flop circuit 166. The flip-flop circuit 166 serves the function of the DOWN LATCH circuit 56 shown in FIG. 2 and is activated in this instance upon the occurrence of the 9700 count in the primary counter 48. Similarly, the output of the gate 161 is applied through a jumper connection 170 to a common line 171 controlling the R input 172 of a flip-flop 173. The flip-flop 173 performs the function of the UP LATCH circuit 57 shown in FIG. 2 and is activated at the beginning of each count cycle of the primary counter 48 until reset by detection of the 300th pulse by the gate 161, signifying the end of the monitoring period or window.

Similarly, to achieve a monitoring window of ±4%, the window control gates 52 include an AND gate 175 for detecting the achievement of count number 9600 by the counter 48 and an AND gate 176 for detecting the achievement of the count 0400 in the counter 48. If the ±4% window is chosen, a jumper connection 178 is made between the output of the gate 175 and the input line 164 to the S input terminal of the flip-flop 166. Similarly, a jumper connection 179 is made between the output of the gate 176 and the input line 171 to the R input 172 of the flip-flop 173.

Finally, to allow selection of a monitoring window of ±5%, the window control gates 52 include an AND gate 182 for detecting the achievement of count number 9500 by the primary counter 48 and an AND gate 183 for detecting the achievement of the count 0500 by the primary counter 48. The output of the AND gate 182 is selectively coupled to the input line 164 of the flip-flop 166 through a jumper connection 195, while the output of the AND gate 183 is coupled to the input line 171 of the flip-flop 173 through a jumper connection 186. It will be appreciated that only one of the connections 170, 179 and 186 will be made at any given time depending upon the choice of window width. Similarly, only one of the connections 163, 178 or 185 will be made at any given time. The choice or these connections and, of course, the choice of window width may be made by a permanent connection made on the circuit board or by a manually controlled switching device on the face of the control panel (not shown).

As noted previously, the primary counter 48 recycles after counting 10,000 pulses, which is the number of pulses generated by the position pulse generator during each forward operating cycle of the working station. To detect the completion of the counting cycle by the primary counter 48, there is provided a gate 190 (FIG. 5B) for detecting the achievement of count number 1000 of the primary counter 48. The output of the gate 190, in addition to effecting the resetting of the counter 48 to count 0000, is effective to reset the DOWN LATCH flip-flop 166 while setting the UP LATCH flip-flop 173. For effecting resetting of the primary counter 48, the output of the AND gate 190 is coupled through an OR gate 192. The output of the OR gate 192 is coupled to one input of another OR gate 193 which controls a SYSTEM RESET line 194. The SYSTEM RESET line 194 is connected to one input of an OR gate 195 the output of which is connected directly to the common reset line 146 for each stage of the primary counter 48. Through the foregoing gates, achievement of the count 10000 by the primary counter 48 is effective to cause resetting of the counter 48 to count 0000.

Activation of the SYSTEM RESET line 194 by achievement of the count 10000 in the gate 190 further serves to energize the R input terminal 198 of the DOWN LATCH flip-flop 166 while energizing the S input terminal 199 of the UP LATCH flip-flop 173.

It will be recalled from the discussion of FIG. 2 that the DOWN LATCH circuit 56 and the UP LATCH circuit 57 respectively control counting down of the secondary counter 54 at the end of a cycle and counting up of the secondary counter 54 at the beginning of the succeeding cycle. Together the states of the DOWN LATCH and UP LATCH circuits 56 and 57 define the monitoring window. Turning then to the secondary counter 54 itself, it is seen in FIG. 5C that the counter 54 includes first, second and third counting stages 210, 211 and 212 representing the 16's, 256's and 512's counts in the secondary counter. The counter stages 210, 211 and 212 are connected in tandem and act as an up-down counter. While devices made by a variety of manufacturers may be used for this purpose, the output and input designations shown for the units 210, 211 and 212 are for model number 4516 manufactured by RCA. Position pulses from the pulse generator appear on the input line 120 (FIGS. 5A and 5B) and are coupled through an AND gate 215 to drive the secondary counter 54 via the CK inputs of the respective stages 210, 211 and 212. The direction of counting by the stages 210, 211 and 212, i.e., counting up or counting down, is controlled by the state of a common input line 216 to each of the stages. The line 216, in turn, is controlled by the Q output 217 of the UP LATCH flip-flop 173. This output, it will be recalled, is in the high state only during the second half of the monitoring window period, and, as such, counting up by the secondary counter 54 only occurs during that period. At all other times, the input line 216 is low or in the "zero" state, during which the secondary counter 54 may count down if position pulses are present. However, means are provided to ensure that these position pulses are only present during that period constituting the first half of the monitoring window. To this end, the AND gate 215 has an input 220 which controls passage of the position pulses to the secondary counter 54. The input 220 of the AND gate 215 is activated by the Q output 221 of the DOWN LATCH flip-flop 166 via an OR gate 222. The OR gate 222 has a second input 223 connected to the Q output 217 of the UP LATCH flip-flop 173. It will be seen, therefore, that passage of the position pulses from the line 120 to the counter 54 is only possible during that portion at the end of each cycle of the primary counter 48 during which the DOWN LATCH flip-flop 166 is activated, which results in opening of the gate 215 via the gate 222. Since the output 217 of the UP LATCH flip-flop 173 is low during this period, counting occurs in the downward direction beginning with a preset count of 0500, 0400 or 0300 depending on the choice of window width. When the DOWN LATCH flip-flop 166 is reset at the end of the count in the primary counter 48, its output 221 goes low. However, the output 217 of the UP LATCH flip-flop 173 simultaneously goes high and, via the OR gate 222, energization of the input terminal 220 of the AND gate 215 is maintained to allow position pulses to pass through the AND gate 215 to continue to toggle the secondary counter 54. Since the output of the UP LATCH flip-flop 173 appearing on the line 216 is now high, counting in the secondary counter 54 begins in the upward direction from the count 000.

For purposes of economy of description, the counting units 210, 211 and 212 and the connections thereto will not be further described in detail and the manufacturer's specifications for these devices are herein incorporated by reference. However, it will be further noted that the secondary counter 54 is prevented from counting while reverse counts are being absorbed in the absorber circuit 46 by the appearance of a signal on the INHIBIT COUNT line 136. The line 136, together with internal connections 225 and 226 in the secondary counter 54, inhibits or prevents the count from registering during selected time intervals defined by the reverse count absorber circuit 46 in the manner described above. A series of input lines 228–233 to the stages 210 and 211 of the secondary counter 54 are provided for the purpose of establishing the initial count from which the counter 54 begins counting down at the beginning of the monitoring window. Since this count will vary with the selected window width, the circuit of FIG. 5C has adjacent to these lines a table showing the necessary connections to the positive supply (designated 1) and ground (designated $\phi$) for the 3%, 4% and 5% window widths. The choice of these connections will, of course, be made to coincide with the choice of window width determined by selection of the connections 170, 179 or 186 and the connections 163, 178 or 185 (FIG. 5B). From the foregoing, it will be seen that the secondary counter 54 is activated only during the monitoring period or window and that its instantaneous count sifnifies the proximity of the count in the primary counter 48 to the reset time for the counter 48.

Turning now to the latch circuit 70 shown in FIG. 5C, it will be recalled that the latch circuit functions to sample the count in the secondary counter 54 upon the occurrence of a scanner pulse occurring during the monitoring window. The binary content of the secondary counter 54 is fed to the latch circuit 70 on a series of parallel lines 71 in the manner shown. While any of a plurality of different devices may be used for the latch circuit 70, the pin designations shown are for a model number 40174 manufactured by RCA. The circuit 70 is shown in FIG. 5C as constituting first and second latch units 236 and 238. While all of the data inputs D1 through D6 of the first unit 236 are used in a normal manner for storage of a digital number, only the first, second and third data inputs D1, D2 and D3 of the unit 238 are employed for this purpose. The data input D4 of the unit 238 is connected to the output line 216 from the UP LATCH flip-flop 173. Through the input D4 the latch unit 238 effectively stores and transfers to its output Q4 a logic state signifying the sign of the registration error, represented by the output state of the UP LATCH flip-flop 173. To effect activation of the latch units 236 and 238 upon the occurrence of a web mark detected by the scanner unit 17, the CK inputs 240 and 242 of the respective latch units 236 and 238 are connected together and activated by a common line 243. This line in turn is activated whenever the scan pulse occurs during the monitoring window. The latter occurrence results from activation of an AND gate 245, the output of which controls the line 243. To ensure that the line 243 is only activated during the monitoring window, one input of the AND gate 245 is controlled from the output of the OR gate 222. Another input to the gate 245 is the scan pulse itself, while a third input is a pulse line designated LOCKOUT to be described below.

Figure 5D:
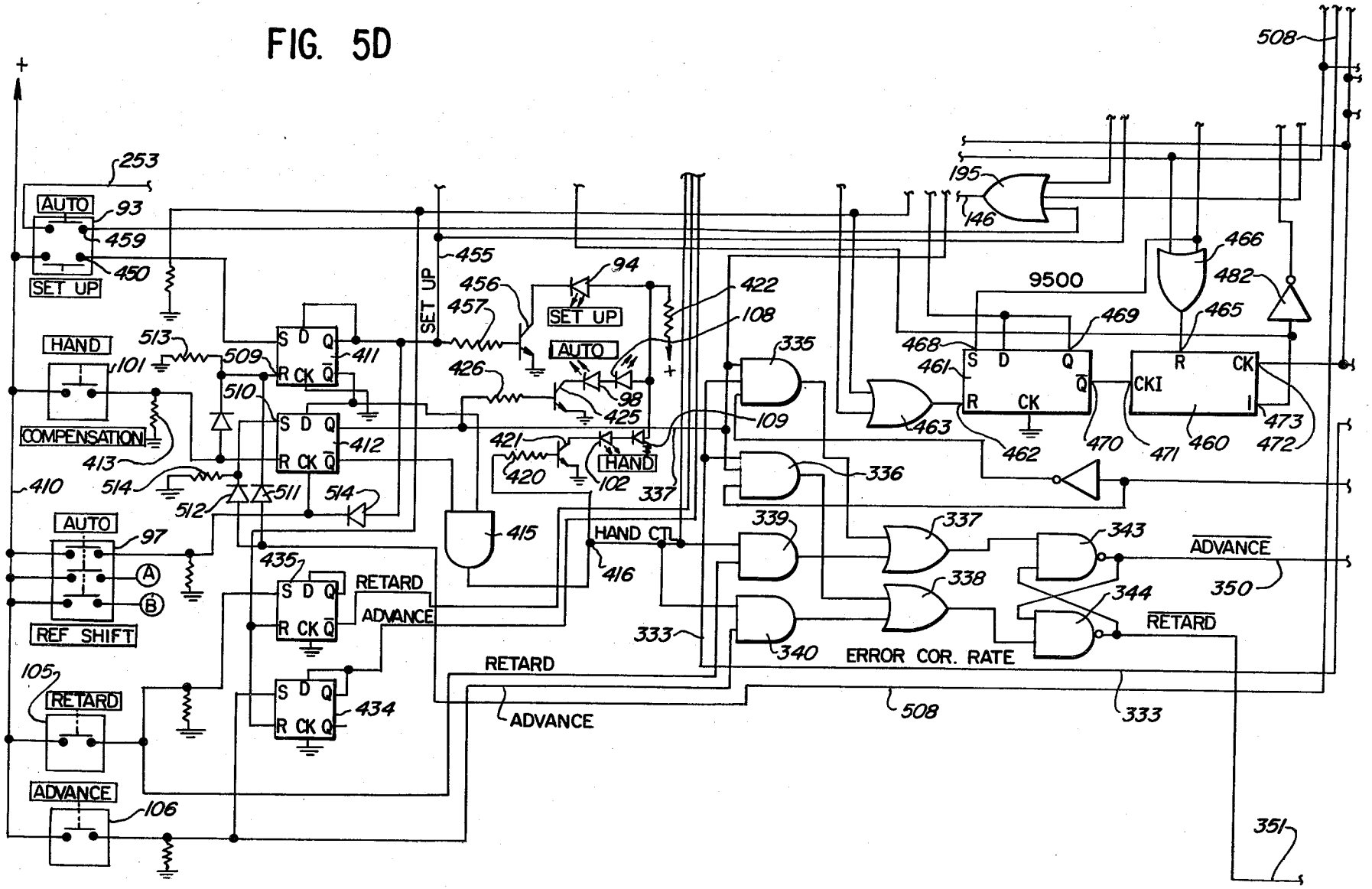
Figure 5E:
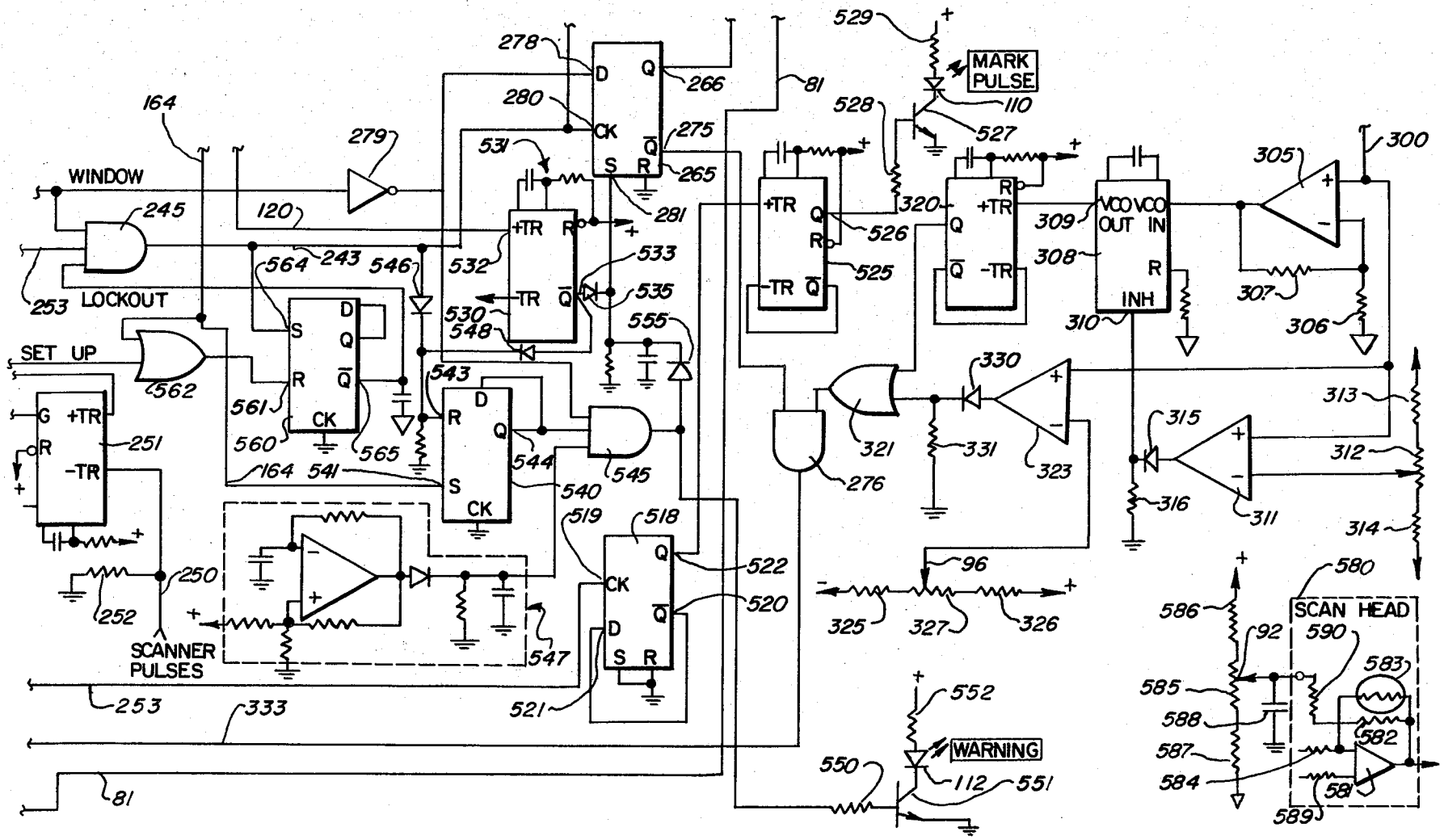

Turning next to the conditioning circuit for the scan pulse itself, it will be seen that the output of the optical scanner is received on an input line 250 and applied to one input of a pulse shaper circuit 251 (FIG. 5E). The pulse shaper circuit 251 is preferably a monostable multivibrator providing a one microsecond pulse in response to any occurrence of a pulse from the optical scanner on the line 250. The resistor 252 references the input of the circuit 251 to ground. The one microsecond output pulse from the circuit 251 is provided on an output line 253 which constitutes one input to the aforesaid AND gate 245. The other functions for which the scan pulse on the line 253 is operative will be described below.

Returning then to the primary signal path, the outputs from the latch circuit 70 are fed in parallel fashion to the D to A converter circuit 74 via the lines 73. The D to A converter circuit may be any of a plurality available to those skilled in the art, but for this application a model number AD7530 manufactured by Analog Devices Incorporated was chosen and pin connections made as shown in FIG. 5C. The manufacturer's specifications for utilizing this device are incorporated herein by reference. While the internal operation of this device will not be described in detail, it is noted that the analog output signal is provided on a terminal 260 and applied to the inverting input 261 of an operational amplifier 262, the noninverting input of which is referenced to ground. The output of the operational amplifier 262 in turn is fed back to the D to A converter circuit 74 via a feedback terminal 263 provided thereon. In certain instances the registration error will be so large as to be outside the range of the monitoring window. This situation is detected by a circuit which includes a flip-flop 265 having its Q output 266 coupled to the most significant digit input terminal 267 of the D to A converter circuit 74 via an OR gate 268. When the Q output 266 of the flip-flop circuit 265 is activated indicating the out-of-range condition, the resulting signal at the input 267 of the D to A converter automatically drives the output voltage from the D to A converter appearing on a line 270 to a level which is beyond the range of the display circuit 77. This condition may be signaled to the operator by any of a variety of ways depending upon the choice of indicators. In one instance this has been signalled by automatic suppression of the last two digits of the indicated registration error.

For the purpose of disabling the compensating motors during the out of range condition just described, the flip-flop 265 further provides a signal at its $\overline{Q}$ output 275. This output controls passage of the compensating motor drive pulses through a gate 276 and thus prevents energization of the motor windings in a manner to be hereinafter described in more detail.

To facilitate detection of the out-of-range condition by the flip-flop 265, the flip-flop has a data input 278 which is controlled by the output of the OR gate 222 via an inverter circuit 279. It will be recalled that the output of the OR gate 222 is activated only during the window period. Thus the input 278 will be at a low potential during the window period and at a high potential outside of the window period. The flip-flop 265 has its CK input 280 coupled to receive the scan pulse from the output of the AND gate 245. If the scan pulse occurs outside of the window period, a pulse will appear at the input terminal 281 to signify the out of range condition. The operation of this circuit will be described in further detail below.

Returning to the primary signal path components, the output of the D to A converter 74 appears on line 270 and is fed to the input of the scaler circuit 76, the output of which is in turn coupled to the display module 77 to drive the readout 79. The scaler circuit, as noted above, allows the operator to select between a readout in inches and a readout in millimeters. To this end, it includes an operational amplifier 285 having its noninverting input terminal coupled to receive the analog output signal from the line 270 and its inverting input terminal referenced to ground through a resistor 286. Gain of the operational amplifier 285, and hence the scale factor of the circuit, is controlled by the choice of various resistors in the feedback networks of the amplifier 285. In the feedback path to the noninverting terminal is a series resistor 288 and a plurality of shunt resistors 289 selectively coupled to ground by selection of one or more jumper connections 290. Alternatively, the output signal of the amplifier 285 may be fed back to the inverting input via one or more of a plurality of series resistors 292, the choice of which is facilitated by a plurality of selectable jumper connections 293. The choice between inches and millimeters is further facilitated by a pair of selectable jumper connections 294 connecting the output of the operational amplifier 285 to an error line 300.

The error line 300 provides an analog voltage to the display module 77 via an input 301 thereto while simultaneously driving the motor control circuits. The display module 77 may be any of a variety of devices commonly available on the market. While it may consist of an analog meter, more typically it will include an A to D converter and display elements to provide a digital readout. A device of this type which has proven useful for this application is a model ICL7107 CMOS A to D Converter and Driver manufactured by Intensil. In addition to the analog input 301, the module has a second input 302 which controls the sign (±) of the registration error in accordance with the SIGN output from the error latch circuit 70 described above. It will be recalled that this signal is positive if sampling of the secondary counter 54 occurs during counting up and negative if sampling of the secondary counter 54 occurs during counting down.

Figure 5F:
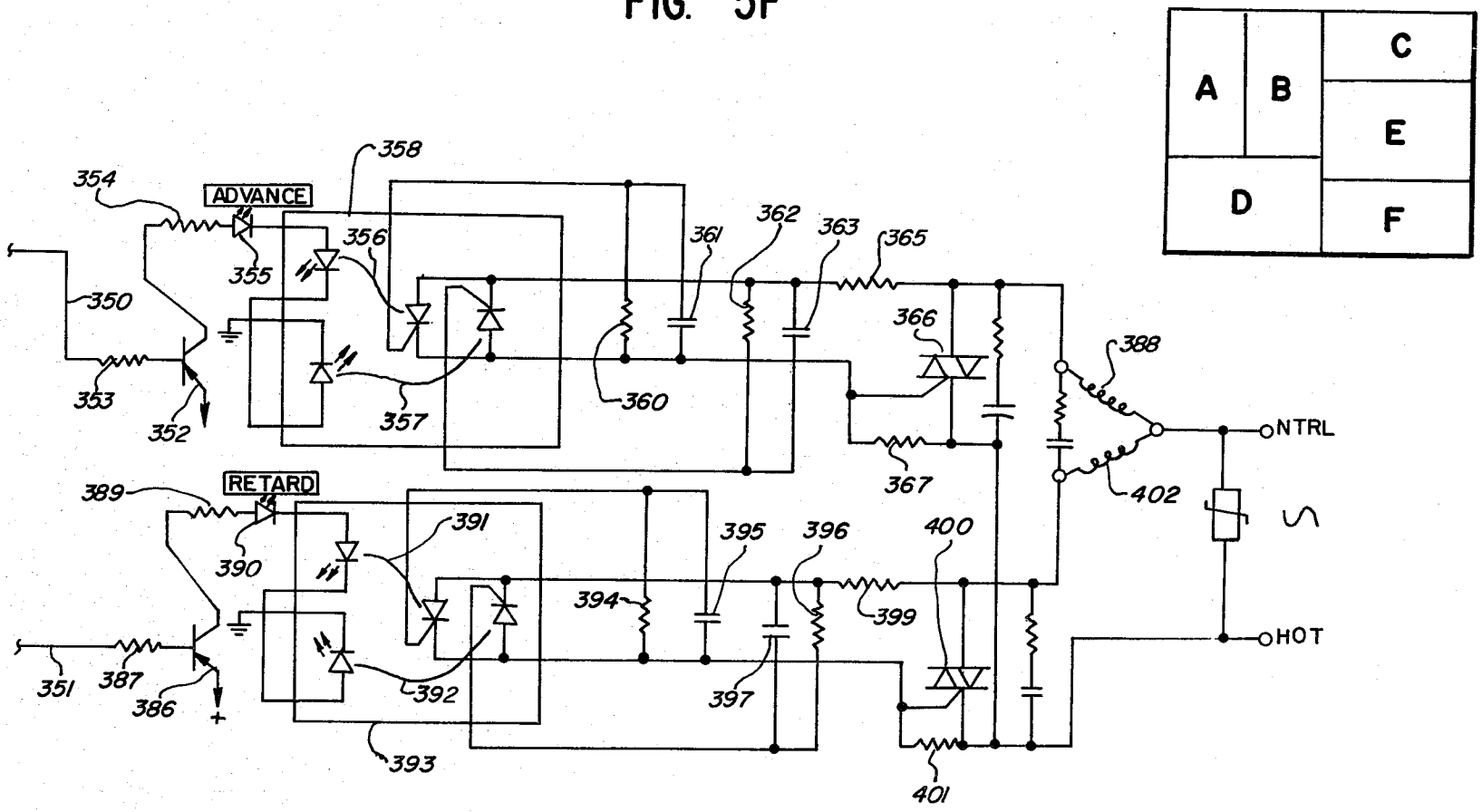

In accordance with another feature of this system, the compensating motor is controlled in a proportional manner by the registration error signal appearing on line 300 so long as the error is within a normal correction band. When this error is larger than the normal correction band, the motor will be controlled to operate at a selected maximum speed. In this manner overly rapid operation of the compensating motor is prevented and smooth correction facilitated. The motor control circuits are shown in FIGS. 5E and 5F. The registration error on line 300 is applied to the noninverting input (+) of an operational amplifier 305, the inverting input of which is referenced to ground through a resistor 306. The output of this amplifier is fed back to the inverting input through a series resistor 307 which controls the voltage gain of the amplifier. The output of the amplifier 305 is coupled to the input of a voltage controlled oscillator circuit 308, the output of which is provided on a terminal 309. A model 4046 device incorporating a voltage controlled oscillator and manufactured by RCA is suitable for this purpose. The oscillator 308 further has an inhibit input terminal 310 controlled by an operational amplifier 311 that acts as a deadband detector. To this end the amplifier 311 has its inverting input terminal coupled to the registration error line 300 and its noninverting input terminal connected to the wiper of a potentiometer 312. The potentiometer 312 is connected in series with a pair of resistors 313 and 314 between the positive and negative supplies to provide a threshold determining circuit against which the registration error signal may be referenced. A diode 315 is connected in series with the output of the amplifier 311 while a resistor 316 references the inhibit input 310 of the VCO circuit 308 to the ground. As thus connected, the potentiometer 312 is adjusted to a voltage corresponding to a desired minimum error for which it is desired to have the compensating motor active. While the registration error on the line 300 is below this level the output of the amplifier 311 is high, inhibiting operation of the oscillator 308. As soon as the registration error on the line 300 exceeds the voltage established on the potentiometer 312 the output of the amplifier 311 goes low, freezing the VCO circuit 308 to provide a series of output pulses corresponding in frequency to the magnitude of the registration error. These pulses are shaped to a constant width by a one-shot circuit 320 and thereafter fed to one input of an OR gate 321.

For large registration errors it is desired to provide a constant voltage to the motor rather than the pulses provided by the voltage controlled oscillator 308. To this end the motor control circuit further includes an operational amplifier 323 having its noninverting input terminal driven by the registration error signal on the line 300. The inverting input terminal of the amplifier 323 is connected to a threshold determining circuit consisting of series resistors 325 and 326 on opposite sides of a potentiometer 327. The potentiometer 327 is controlled by the motor speed control adjustment 96 on the operator's panel. The output of the amplifier 323 is coupled to one input of the OR gate 321 through a diode 330, the cathode of which is referenced to ground through a resistor 331. Typically the threshold level for the amplifier 323 is chosen by adjustment of the control 96 so that the amplifier 323 is activated by a registration error in excess of 0.015 of an inch. At this level, the error voltage on the line 300 exceeds the voltage selected on the potentiometer 327 and thereafter the output of the amplifier 323 goes high. This output signal is applied through the OR gate 321 and the AND gate 276 to provide a constant voltage drive for operating the motor at a fixed maximum speed. The output of the gate 276 controls the motor via a line 333 designated ERROR COR. RATE.

The compensating motor drive signal on line 333 is simultaneously applied to one input of each of a pair of gates 335 and 336 which are activated during the automatic control mode (AUTO) of the system. The outputs of these gates are, in turn, respectively connected to a pair of OR gates 337 and 338 (FIG. 5D). The other inputs to the gates 337 and 338 are provided by a pair of gates 339 and 340, respectively, which are actuated during the manual mode (HAND) to allow the operator to assume manual control over the compensating motor in a manner to be described below. The output of the OR gate 337 is connected to one input of a NAND gate 343 while the output of the OR gate 338 is connected to one input of a NAND gate 344. The NAND gates 343 and 344 are connected in an RS flip-flop configuration, the output of each driving one input of the other. These gates ensure that the motor is commanded to drive in only one direction at a time. In order that the compensating motor may be commanded to operate in the proper direction in response to the registration error, the signal on line 81 from the output of the latch circuit 70 (FIG. 5C) is coupled to one input of the motor control gate 336 directly and to one input of the motor control gate 335 through an inverter 346. The final input to each of the AND gates 335 and 336 is activated by a common control line 337 which is energized during the automatic mode (AUTO) in a manner to be hereinafter described.

It will be seen therefore, that the gate 335 operates to effect advancement of the compensating motor at a rate determined by the frequency of the constant width pulses on the line 333 whenever the error detected by the latch circuit 70 is negative. Similarly, the AND gate 336 operates to effect retarding of the compensating motor at a rate proportional to the frequency of the constant width pulses on the line 333 whenever the registration error detected by the latch circuit 54 is of a positive sense.

The actual control of current through the windings of the compensating motor is accomplished by the circuit shown in FIG. 5F. The motor advance signal is received from the NAND gate 343 on a line 350 and is applied to a gating transistor 352 through a series resistor 353. The emitter of the transistor 352 is connected to the positive supply while the collector drives a series circuit consisting of a resistor 354, a light emitting diode 355 and a pair of optical triacs 356 and 357 which form an isolator circuit 358. The light emitting diode 355 controls the ADVANCE indicator 116 on the operator's control panel. The optical isolator circuit 358 is provided for the purpose of isolating the low voltage section of the circuit from the high voltage and high current section controlling the motor winding directly. The receiver SCR of the optical isolator 356 has its gate circuit controlled by a parallel circuit consisting of a resistor 360 and capacitor 361. Similarly, the receiver SCR of the optical isolator 357 has its gate terminal controlled by a parallel circuit consisting of a resistor 362 and capacitor 363. The receiver SCRs for the optical isolators 356 and 357 are oppositely poled and in parallel across a circuit which includes a resistor 365, a high current triac 366 and a resistor 367. The gate terminal of the triac 366 is connected between the resistor 367 and the anode of the receiving SCR of the optical isolator 357. The triac 366 in turn controls current flow from the AC supply terminals through a winding 388 of the compensating motor 84 to effect advancement of the web by the compensating mechanism.

A similar circuit controls operation of the motor in the opposite direction to retard the web via the compensating mechanism. To this end, the output from the NAND gate 344 (FIG. 5D) is provided on a line 351 which controls a transistor 386 through a series resistor 387. The emitter of the transistor 386 is referenced to the positive supply while the collector is coupled through a series circuit including a resistor 389, a light emitting diode 390, and a pair of series connected diodes constituting the emitters of a pair of optical triacs 391 and 392. The optical isolators 391 and 392 form a part of an isolator circuit 393 which is provided for the purpose of separating the low voltage section of the circuit from the high voltage and high current devices controlling the motor 84. A gate circuit for the receiving SCR of the optical isolator 391 is supplied with current through a parallel RC circuit consisting of a resistor 394 and capacitor 395. Similarly, the gate circuit for the receiving SCR of the optical isolator 392 is supplied with current through an RC parallel circuit consisting of a resistor 396 and capacitor 397. The receiving SCRs of the optical isolators 391 and 392 are oppositely poled and connected across a series circuit consisting of a resistor 399, a high current triac 400 and a resistor 401. The gate terminal of the triac 400 is connected between the resistor 401 and the anode of the receiving SCR of the optical isolator 392. To complement the triac 366, the triac 400 controls current flow through a second winding 402 of the compensating motor 84 from the AC supply. When activated, the triac 400 causes current to flow through the winding 402 of the motor 84 and the motor is commanded to adjust the compensating mechanism to retard the longitudinal position of the web relative to the press working station. Thus a signal on the line 350 causes advancement of the web through the operation of the compensating motor while a signal on the line 351 causes retarding of the web. Whether the web is being shifted manually in the HAND mode or automatically in the AUTO mode, the direction of movement of the compensating motor 84 will be signalled to the operator by the light emitting diode 355 or 390 as the case may be. As noted above, the speed of the motor in either direction will be dependent upon the frequency of the constant width pulses on the line 333 designated ERROR COR. RATE.

AUXILIARY CONTROL MODES

The description provided thus far for FIGS. 5A–5F encompasses the components of the basic system control loop and those aspects of the system which control registration primarily during the automatic correction mode. At least three additional major modes of operation are provided by the registration control system of the present invention. These include a manual mode designated HAND on the control panel, the AUTO SETUP mode and the REFERENCE SHIFT function.

Turning first to the HAND or manual mode, it will be recalled from the discussion of FIG. 4 that the manual mode becomes available as soon as power is supplied to the system by depression of the pushbutton 90 designated POWER. This mode allows the operator to take control of the compensating motor directly to advance or retard the web, as desired, to achieve an initial registration condition in which the web is properly aligned with the work station. This task is performed visually by the operator. He may, for example, align the web with the cutting blade 24 on the shearing drum 23 shown in FIG. 1 so that a desired centering of the print pattern on the cut page results.

The mode control switches, latches and indicators are shown primarily on FIG. 5D. Manual control of the compensating motor is effected by depression of the HAND pushbutton 101 which connects a positive supply line 410 to the reset input of a pair of latching flip-flops 411 and 412. A resistor 413 references this signal to ground. The $\overline{Q}$ output of the flip-flop 412 controls one input of an AND gate 415, while the other end of the AND gate 415 is controlled by the $\overline{Q}$ output of the flip-flop 411. The output of the AND gate 415 controls a line designated HAND CTL. This line serves to activate one input of each of the motor control gates 339 and 340, while the other input to each of the gates 339 and 340 is selectively coupled to the positive supply line 410 by depression of either the RETARD pushbutton 105 or the ADVANCE pushbutton 106. It is seen, therefore, that depression of the pushbutton 101 resets each of the latching flip-flops 411 and 412 so that their $\overline{Q}$ outputs go high. This in turn causes the output of the AND gate 415 and the HAND CTL line 416 to go high, opening the gates 339 and 340. Control of the compensating motor 84 in either the forward or reverse direction is thereafter accomplished by depression of either the ADVANCE pushbutton 106 or RETARD pushbutton 105 as desired. An indicator circuit for the manual mode is also controlled by the output of the gate 415 and includes a series resistor 420, a transistor 421 and the light emitting diode 102 appearing on the control panel. The diode 102 is connected between the collector of the transistor 421 and the positive supply through a series resistor 422. As thus connected the indicator diode 102 is illuminated whenever the pushbutton 101 is activated to place the system in a manual mode.

The automatic mode may be selected either manually through depression of the pushbutton 97 or automatically through the AUTO SETUP pushbutton 93 in a manner to be hereinafter described. Manual depression of the AUTO mode pushbutton 97 connects the positive supply line 410 to the CK input of the flip-flop 412 and changes the state of the flip-flop 412 so that the Q output thereof assumes the state of the $\overline{Q}$ output of the flip-flop 411. A high logic level at the $\overline{Q}$ output of the flip-flop 411 activates the AUTO mode control line 337 and an indicator circuit consisting of the light emitting diode 98, a control transistor 425 and a base resistor 426. As the auto mode control line 337 goes to a high potential, the transistor 425 is biased into conduction through the base resistor 426 and draws current through the light emitting diode 98 to signal the operator that he is operating in the AUTO mode. The auto mode control line 337, as described above, additionally enables each of the control gates 335 and 336 for the compensating motor.

In accordance with another feature of the present invention, the RETARD and ADVANCE pushbuttons 105 and 106 may be used during the automatic mode to slowly shift the reference point for the error monitoring system to effect a change in the registration condition between the print patterns on the moving web and the position of the work station within its cycle. To this end, the AUTO mode control line 337 additionally controls one input of each of a pair of gates 431 and 432 (FIG. 5B). The gate 431 has an additional input provided by the output of a gate 433 in the counter control gates 52 which is activated upon achievement of count 9999 by the primary counter 48. The third input to the gate 431 is provided by the output of a flip-flop 434, the S input of which is, in turn, controlled by the ADVANCE pushbutton 106 on the control panel. The output of the gate 431 provides one input to the OR gate 192 which, in turn, activates the SYSTEM RESET line 194 through the OR gate 193. It will be seen, therefore, that during the automatic mode depression of the ADVANCE pushbutton 106 on the operator's panel sets the flip-flop 434 and results in a condition whereby the system reset pulse occurs at count 9999 rather than at count 10,000. Thus the counter 48 repetitively resets one pulse sooner than normal and the monitoring window is effectively shifted by one pulse during each cycle of the primary counter 48.

In a similar manner, the AND gate 432 provides for retarding of the resetting for the primary counter 48 and effectively shifts the window in the opposite direction. To this end, the AND gate 432 has a second input which is received from the Q output of the final stage 144 of the primary counter 48. A third input to the AND gate 432 is provided by the number 1 output line of the first decade counter unit 140 of the primary counter 48. As thus connected, the output of the gate 432 goes high during the automatic mode only when the count 10001 is achieved by the counter 48. Since the counter 48 normally resets upon achievement of count 10000, it is necessary to inhibit resetting in the normal manner during manual retarding of the reference point. To this end, the 10,000 pulse reset gate 190 has its third input controlled from the output of a flip-flop or latch circuit 435, the S input of which is controlled by the RETARD pushbutton 105. Thus, whenever the RETARD pushbutton 105 is pushed during the automatic mode, flip-flop 435 is activated such that its $\overline{Q}$ output goes low, disabling the AND gate 190 and preventing reset of the primary counter 48 upon achievement of count number 10,000. The counter 48 is thus allowed to continue running until count 10001, which activates the gate 432 and, in turn, activates the system reset line 194 one count later than usual. So long as the RETARD button 105 is held during this automatic mode, the primary counter 48 will continue to reset one count or pulse later than usual so that the monitoring window is effectively retarded at a rate of one pulse per cycle.

AUTO SETUP

A further important feature of the present invention lies in the system's ability to automatically and rapidly synchronize itself to the registration condition set up by the operator during his initial positioning of the web relative to the work station. The automatic set up controls serve the further function of preventing synchronization until only one web mark is detected during the monitoring window by the scanner. When more than one mark appears during the window the system effectively shifts the window repetitively until only one mark appears during the monitoring window.

The AUTO SETUP mode is actuated by depression of the pushbutton 93. This closes a contact 450 to connect the positive supply line 410 to the S input terminal of the auto setup flip-flop 411. The flip-flop 411 acts as a latch circuit that is activated during the AUTO SETUP mode to provide a high logic level at its Q output which controls a line designated SETUP. To alert the operator that he is operating in the SETUP mode there is provided a display circuit including a transistor 456 which controls current through the light emitting diode 94 on the control panel. A series resistor 457 connects the base of the transistor 456 to the SETUP line 455 while the emitter of the transistor 456 is coupled to ground.

During automatic setup several functions are accomplished. First, the primary counter 48 is reset upon the occurrence of the first scanner pulse from the pulse shaper circuit 251 (FIG. 5E). Second, means are provided for monitoring the optical scanner output during the initial monitoring windows to determine whether more than one pulse is present within the window period. If only one pulse is within the window, the system is synchronized so that the scanned pulse is initially at the very center of the window, and thereafter the system is tripped to the automatic mode. If more than one pulse occurs within the monitoring window, the system shifts the window in 200 count increments of the primary counter 48 until only one scan pulse occurs within the window. It then checks to see whether the window continues to contain only one pulse for three successive cycles before tripping the system into the automatic mode. The manner in which each of these functions is accomplished is described below.

In order that the primary counter 48 may be reset upon occurrence of the first scanner pulse after activation of the AUTO SETUP pushbutton 43, a second normally open switch 459 is provided in the pushbutton 93 which connects the scanner pulse from the line 253 to one input of the OR gate 195 controlling the reset line 146 of the primary counter 48. The resetting of the primary counter 48 is thus synchronized with the first registration mark detected.

Simultaneously, switch contacts 450 of the pushbutton 93 couple the positive supply line 410 to a plurality of components which are provided for ensuring that only one pulse occurs within the monitoring window. For counting the pulses occurring within the monitoring window there is provided a decade counter 460 which is activated by a latch circuit 461. The latch circuit 461 is a D-type flip-flop having its reset (R) terminal 462 controlled by an OR gate 463, one input of which is activated during the setup period by the switch 450 in the pushbutton 93. The reset terminal 465 of the decade counter 460 is similarly controlled through an OR gate 466, one input of which is activated during the setup period by the pushbutton switch 450. The S input 468 of the latch flip-flop 461 and the other input to the OR gate 466 controlling the reset terminal 465 of the counter 460 are controlled by the output of the counter control gate 182, which detects the occurrence of count number 9500 in the primary counter 48. In operation, therefore, depression of the AUTO SETUP button 93 resets the latch flip-flop 461 through the OR gate 463 to ensure a low level output at the Q output 469 and trigger a high output at the $\overline{Q}$ output 470. The $\overline{Q}$ output 470 controls decade counter 460 via the clock inhibit (CKI) input terminal 471 thereto. Both the latch circuit 461 and the decade counter 460 remain in the quiescence condition until the detection of count number 9500 by the counter control gate 182. At this point the latch flip-flop 461 is toggled to its set state via its input terminal 468, causing the $\overline{Q}$ output 470 to go low, thus enabling the decade counter 460. This initiates the monitoring window. The scanner output pulses, properly shaped in the pulse shaper circuit 251, are applied to the CK input 472 of the decade counter 460. When the first scan pulse is received at the input 472 during the window period, the number 1 output 473 goes to a high logic state. If no subsequent pulses are generated by the scanner during the window period the output 473 remains high and the detected registration mark is considered satisfactory for synchronization purposes. Thus, synchronization can take place. If, however, a subsequent scanner pulse appears at the input 472 of the flip-flop 460 during the window period, the number 1 output 473 goes to a low logic state, preventing synchronization and triggering the window shifting function to be described below.

Assuming for the moment that only one pulse has occurred within the monitoring window, synchronization can now be accomplished. To this end, the output 473 of the decade counter 460 is applied via a line 474 to one input of an AND gate 477. The output of the AND gate 477 in turn controls the S input 476 of a D-type flip-flop 475. A second input to the AND gate 477 is provided by a gate 479 within the counter control gates 52 and is activated upon detection of count number 1100 in the primary counter 48. The third input to the gate 477 is from the SETUP line 455 from the output of the auto setup latch 411. As thus connected, the synchronizing latch 475 is triggered to its set condition, providing a high logic state at its Q output, shortly after the monitoring window is complete during the setup period. The Q output 478 of the synchronizing latch 475 in turn controls one input of an AND gate 479. A second input of the AND gate 479 is coupled to the Q output 469 of the latch flipflop 461 to provide an enabling signal that exists during the monitoring window. A third input for the AND gate 479 is provided by the scan pulse output of the pulse shaper circuit 251. Therefore, during the monitoring period subsequent to the first achievement of a single pulse within the monitoring window, the scan pulse is effective to shift the output of the AND gate 479 to the logic one state. This output signal, provided on a line 481, and designated SYNC, is applied to a third input of the reset controlling OR gate 195 to effect resetting of the primary counter 48 via its common reset line 146. At the same time the output signal on the line 481 is fed back to the R input 482 of the synchronizing latch circuit 475.

Assuming, however, that synchronization can not yet be accomplished because more than one web mark has been detected during the monitoring period by the counter 460, a different set of circumstances occurs. Upon the occurrence of the second scan pulse during the monitoring window the output 473 of the decade counter 460 goes to a low state. This in turn causes the output of the inverter 482 to go high. In accordance with another aspect of the present invention means are provided for shifting the monitoring window during the setup mode whenever more than one scan pulse occurs within the monitoring window. To this end, a three input AND gate 485 is provided having an output 486 controlling a shift command line 487. One input for the AND gate 485 is provided by the output of the inverter circuit 482 just bescribed. A second input is provided by the SETUP line 455 which is activated during the setup period.

The third input 484 is controlled by an OR gate 483 having a pair of inputs 488 and 489 which are respectively controlled by gates 490 and 491 of the counter control gates 52. The shift control line 487 from the output of the AND gate 485 is fed to one input of an OR gate 493, the other input of which is provided by the carry output (CO) from the second decade counter stage 141 of the primary counter 48.

Thus, shifting of the monitoring window occurs in the following manner. If more than one pulse is counted by the decade counter 460 during the monitoring window, the output 473 goes low, causing the output of the inverter 482 to go to a high logic level. This, in turn, activates the shift control gate 485. However, the output 486 of the gate 485 remains low until count number 1590 is detected by the gate 490 in the counter control gates 52. Detection of this count creates a high logic level at the input 488 of the OR gate 483 and passes a pulse to the input 484 of the gate 485 that activates the shift command line 487 momentarily. The pulse on the line 487 is coupled back through the OR gate 493 at the CK input of the hundreds unit 142 of the primary counter 48. This causes the count in the counter 48 to be automatically incremented by 100 positions or effectively shifted by 1%. Counting then continues from the count 1690 until AND gate 491 of the counter control gates 52 is activated at count number 1790. This creates a pulse at the input 489 of the OR gate 483 which is coupled in turn to the input 484 of the AND gate 485 to activate the shift command line 487 once more. This pulse is, in turn, applied to the OR gate 493 to clock the third stage 142 of the primary counter 48 one more time. This effectively results in a shift of another 100 counts by the counter 48 and a shift of the monitoring window by another 1%. Thus the location of the window relative to the occurrence of the web marks has shifted by approximately 200 counts of the primary counter 48. It will be noted that shifting of the window is always in the same direction.

Upon the next achievement of count number 9500 by the counter 48 the latch 461 and decade counter 460 will again be triggered to their reset condition and the counter 460 will begin again to register the scanning pulses received during the next monitoring window. This sequence of checking for one pulse within the window will continue and shifting by 200 counts will occur until the condition arises where only one scanner pulse is found within the monitoring window. At this point the synchronization latch 475 will again be activated to ensure that the start of the counting cycle by the counter 48 coincides with the occurrence of the scan pulse in the manner previously described.

However, once it is determined that only one pulse is occurring within the window, a further check is made to ensure that this condition remains for multiple cycles of the counter 48. To this end, a counter circuit 500 is provided which has its reset input 501 controlled by a three input OR gate 502. The OR gate 502 receives input from the shift control line 487, the contacts 450 of the AUTO SETUP button 93 and from an output terminal 504 of the counter 500 which is activated as hereinafter described. The counter 500 is clocked at an input terminal 505 by a signal received from the output of the AND gate 477 (FIG. 5A) of the synchronizing circuit on a line 506. The counter circuit 500, through the foregoing connections, is reset to the zero state whenever a shift command is made by the gate 485, whenever the setup button 93 is activated and whenever the counter 500 has itself achieved its third count. Clock pulses to the input terminal 505 can only result during synchronizing cycles occurring after it has been determined that only one web mark is occurring during the monitoring window. Therefore, even if the decade counter 460 determines that only one pulse is occurring within the window, the output 504 of the counter 505 will not be activated until this condition remains for three successive cycles.

Once it is determined that the system is synchronized and only one pulse has occurred within the window during three successive cycles, the system is automatically transferred from the automatic setup function to the auto mode. This is accomplished by connection of the output 504 of the counter 500 via a line 508 to the reset (R) terminal 509 of the latching flip-flop 411 and to the S input terminal 510 of the flip-flop 412 (FIG. 5D). A diode 511 connects the line 508 to the input 509 of the flip-flop 411 while a diode 512 connects the line 508 to the S input 510 of the flip-flop 412. The inputs 509 and 510 are respectively referenced to ground through resistors 513 and 514. In operation, therefore, detection of the third successive cycle with only 1 mark in the monitoring window causes the output 504 of the counter 500 to go high, resetting the auto setup flip-flop 411, deactivating the SETUP indicator diode 94 and setting the flip-flop 412 to the logic 1 state. This activates the AUTO control line 337 and the AUTO indicator diode 98 on the control panel to signal the operator that set up is complete and automatic operation is underway.

To ensure normal resetting of the primary counter 48 during the manual or HAND mode, there is provided in FIG. 5B an AND gate 510 having inputs derived respectively from the HAND CTL line 416, the Q output of counter stage 144 and the zero count output of the decade counter stage 140. The AND gate 510 in turn provides one input of the OR gate 193 which controls the SYSTEM RESET line 194. Whenever hand control is assumed by depression of the pushbutton 101, therefore, the counter 48 is allowed to complete its normal counting cycle of 10,000 counts before activation of the common reset line 146 by the gates 510, 193 and 195.

Upon resetting of the flip-flop 411 at the conclusion of the auto setup period the Q output thereof goes low and the Q output goes high. The Q output is coupled back to the CK input of the flip-flop 412 through a diode 514. The drop in the Q output of the flip-flop 411, therefore, at the end of the setup period toggles the flip-flop 412 to its set state, creating a high logic level at its Q output which activates the auto mode control line 337.

Several additional functions are provided by those portions of the circuit shown in FIG. 5E. First, for activating the mark pulse indicator 110 on the front of the control panel so that it flashes in synchronism with occurrence of the mark pulses, there is provided a divide-by-two counter in the form of a flip-flop 518 having its CK input 519 driven by the scan pulse output line 253 of the shaper circuit 251. To effect division by 2 the Q output 520 is fed back to the data input 521 in the manner well known in the art. The Q output 522 from the flip-flop 518 thus provides a pulse train at half the frequency of the scan pulses occurring on line 253. This signal in turn is applied to a pulse shaper circuit 525 which is effectively a monostable multivibrator for controlling the duration of the divided scanner pulses. The output of the pulse shaper circuit 525 is taken from the Q output terminal 526 and applied to the base of a transistor 527 through a series resistor 528. The transistor 527 is in a grounded emitter configuration and controls current flow through the light emitting diode 110 on the system control panel and a series resistor 529 connected to the positive supply. In operation, the scanner output pulses occurring on the line 253 are divided in frequency by the circuit 518 and shaped by the monostable circuit 525 for driving the LED indicator 110, signifying the occurrence of mark pulses on the web. Frequency division is necessary to allow flashing of the indicator 110 to be detected when mark pulses are occurring at a very high rate due to fast movement of the web.

As a further feature of the present invention means are provided for disabling the correcting motor and signalling the operator upon the detection of several dangerous conditions. One of these conditions arises when the speed of the press becomes so slow that effective error correction can no longer be provided. For detecting this condition, there is provided a one-shot multivibrator circuit 530 having an RC timing network 531. The circuit 530 is triggered via an input 532 and provides an output on its $\overline{Q}$ terminal 533. The input terminal 532 is connected to the position pulse line 120 from the position pulse generator. In operation, the logic level at the $\overline{Q}$ output terminal 533 remains low in voltage so long as the position pulses occurring on the line 120 are spaced by a time period which is shorter than the time period of the monostable as determined by the RC circuit 531. If for any reason the press slows down to an unreasonably low speed, or if the press is shut off causing a drop in speed, the position pulses on the line 120 becomes spaced by a greater amount than the time constant of the circuit 530 and the voltage level at the $\overline{Q}$ output 533 goes high. This voltage is conveyed through a diode 535 to the S input 281 of the flip-flop 265 described above to trigger the flip-flop to its set state, driving the $\overline{Q}$ output 275 low and the Q output 266 high. The low level of the $\overline{Q}$ output 275 serves to disable the command pulses to the motor by inhibiting passage of pulses through the AND gate 276. Simultaneously the operator is alerted to the condition by the fact that the last two significant digits on the display are suppressed as a result of the high voltage level at the Q output of the flip-flop 265.

As another safety feature of this system, means are provided for flashing the warning light 112 and disabling the compensating motor whenever the scan pulse fails to occur within the monitoring window. To this end there is provided a flip-flop 540 having its S input terminal 541 coupled to the line 164 (FIG. 5B). It will be recalled that the line 164 assumes a high level logic state at the initiation of the monitoring window as determined by the counter control gates 52. The reset input 543 of the flip-flop 540 is driven by the scanner pulses occurring on the line 243. The Q output 544 of the flipflop 540 provides one input to a three input AND gate 545. The other inputs to the AND gate 545 are provided respectively by the output of the inverter 279 and a warning oscillator circuit 547. The warning oscillator circuit 547 may be any of a variety of different circuits that provide a repetitive signal at a relatively low frequency. The output of the gate 545 controls the warning indicator diode 112 on the control panel through a series resistor 550 controlling the base of a transistor 551. The transistor 551 is in a grounded emitter configuration and controls current through the diode 112 and a series resistor 552 coupled to the positive supply. In operation, the flip-flop 540 is triggered to its set condition at the beginning of the monitoring window by the logic level appearing at its input terminal 541. Normally, the flip-flop 540 will be reset during the monitoring window by a pulse appearing at its reset terminal 543. However, if a pulse fails to appear due to a failure of a web mark to occur during the window, the flip-flop 540 will not be reset during the monitoring period and its output 544 to the gate 545 will continue to remain at a high level subsequent to the end of the monitoring window. It will be recalled that at the end of the monitoring window, the output of the inverter 279, which controls the third input of the gate 545, goes high. Simultaneous high conditions at each of the inputs to the gate 545 thus causes the output of the gate to rise to a high level repetitively with each output pulse from the warning oscillator 547. This pulsating signal in turn flashes the warning indicator 112 through the control transistor 551. To ensure that the warning light is not activated upon each slowdown or stoppage of the press, the $\overline{Q}$ output of the monostable 530 is also effective, when activated, to reset the flip-flop 540 through a diode 548 coupled to the R input terminal 543 of the warning light flip-flop 540. Simultaneously, the output of the gate 545 is applied through a diode 555 to the S input 281 of the motor disabling flip-flop 265, triggering the flip-flop to its set state, disabling the motor drive pulse gate 276 and driving the display to its overload condition to further signal the operator of the problem.

As still another feature of the present invention, means are provided for preventing multiple error registrations in the latch circuit 70 when more than one web mark occurs during the monitoring window. This condition may occur not only during setup but during operation in the auto mode and in particular when a registration error causes the primary web mark being monitored to deviate from the center of the monitoring window by a substantial amount. Therefore, in order to prevent the latch circuit 70 from sampling more than once during the monitoring window, there is provided a flip-flop 560 having a reset input 561 controlled by an OR gate 562. The OR gate 562 has a first input selectively provided by the positive supply through actuation of the AUTO SETUP button 93 and contacts 450. A second input to the OR gate 562 is provided by the window initiating signal appearing on line 164 (FIG. 5B). The S input 564 to the flip-flop 560 is driven by the output of the AND gate 245, while the AND gate 245 itself has one input designated LOCKOUT controlled by the $\overline{Q}$ output 565 of the flip-flop 560. In operation, the initial setup pulse provided by depression of the AUTO SETUP pushbutton 93 passes through the OR gate 562 and resets the flip-flop 560 such that its $\overline{Q}$ output 565 goes high. This in turn partially enables the gate 245. The gate 245 is fully enabled at the initiation of the window period by the appearance of a high logic level on the line 224 from the OR gate 222. Thereafter the first scan pulse on the line 253 from the shaper circuit 251 passes through the gate 245 to clock or activate the latch circuit 70. Simultaneously, the scan pulse toggles the flip-flop 560 via the set input 564 and causes the $\overline{Q}$ output 565 thereof to go to a low logic level. The gate 245 is thus disabled for the rest of the window period and subsequent scan pulses are prevented from activating the latch circuit 70 until the beginning of the next window period. When the next window period begins, the line 164 goes to a high logic level and, through the OR gate 562 activates the R input 561 of the flip-flop 560 to repeat the cycle. In this manner, only one pulse is allowed to activate the latch circuit 70 during each counting cycle of the primary counter 48 and spurious error registrations are ignored.

As still a further feature of the present invention means are provided for altering the sensitivity of the scanner head optics from the operator's control panel. To this end, the circuits shown in FIG. 5E in the lower right hand corner depict the circuitry generally provided within the scan head by the manufacturer. The scan head, designated 580, includes an operational amplifier 581 having a feedback path including a fixed resistor 582 and a thermistor 583 for controlling gain. A photovoltaic element (not shown) provides excitation through a pair of input resistors 584 and 589. The scan head circuitry described thus far is provided by the scan head manufacturer. To provide for a remote control of the sensitivity of the scan head circuitry the present system incorporates a threshold setting circuit including a potentiometer 585 in series circuit with resistors 586 and 587 between the positive and negative supply voltages. The wiper of the potentiometer 585 is controlled from the operator's control panel via the sensitivity adjustment screw 92 (FIG. 4) and is referenced to ground potential through a capacitor 588. A series resistor 590 within the scan head circuitry couples the potentiometer wiper 92 to the inverting input terminal of the operational amplifier 581. As thus described, the sensitivity control 92 is effective to adjust the threshold voltage at the inverting input terminal of the operational amplifier 581 and thus effectively control the sensitivity of the scan head to color and intensity variations on the web. It will be appreciated, of course, that the scan head 580 further includes other components not shown including a light source for emitting the beam to be reflected from the web for detection purposes.

From the foregoing, it will be seen that there has been brought to the art a registration control system which has many features and advantages heretofore unavailable in systems of this type. The system is all digital in nature, inherently accurate and easy to use. As such, the system is a substantial advancement in the technology of registration control.

What we claim is:

1. A system for controlling registration in a printing press between a moving web having repetitive print patterns and a work station operated cyclically in synchronism with the press by the press drive comprising pulse generating means coupled to said work station for producing a train of position pulses each of which corresponds to predetermined movement of said work station;

registering means coupled to said generating means for cyclically registering the count of said position pulses during each cycle of said work station;

web scanner means positioned along said web path and adapted to produce an output signal in response to pssage of a selected portion of each successively occurring print pattern on said web; and, means coupled to said registering means and scanner means for monitoring the output of said scanner means during a predetermined portion of the count in said registering means and for signalling a registration error whenever the interval between successive scanner output signals differs from the repeat period of said registering means, said pulse generating means being operative to produce a first train of pulses during movement of said work station in the forward direction and a second train of pulses during movement of said work station in the reverse direction, gating means for normally coupling said first train of pulses to said registering means and a gate inhibit circuit coupled to said gating means and said pulse generating means, said gate inhibit circuit including a counter for counting the pulses of said second pulse train during reverse operation of said work station and then operating for a corresponding number of counts during forward operation of said work station, said gating means being inhibited during operation of said inhibit circuit counter for inhibiting the registering of a count by said registering means during operation of said inhibit circuit counter in said reverse and forward operation, whereby said registration system is nonresponsive to temporary discontinuities and backups in the operation of said press.

2. A system according to claim 1 for controlling registration in a printing press wherein said work station is a web cutting cyliner and said pulse generating means includes an encoder coupled to said cutting cylinder for producing said position pulses during each revolution of said cylinder.

3. A system according to claim 1 for controlling registration in a printing press wherein said system further includes a shifting device for varying the longitudinal position of said web in relation to the work station and wherein said shifting device is coupled to said monitoring means and responsive to said registration error to adjust said web longitudinally in its path so as to reduce said registration error.

4. A system according to claim 3 for controlling registration in a printing press wherein said web shifting device includes a web advance and retarding mechanism, motor means for driving said mechanism and a proportional motor control circuit for varying the speed of said motor means in proportion to the magnitude of said registration error.

5. A system according to claim 4 for controlling registration in a printing press further including a manual control and means responsive to said manual control for driving said motor means.

6. A system according to claim 1 for controlling registration in a printing press wherein said system further includes a visual display coupled to said error signalling means for manifesting the sense and magnitude of said registration error.

7. A system according to claim 1 for controlling registration in a printing press wherein said scanner means is an optical transceiver device generating a beam which is detected after reflection from said web and wherein said system further includes remote manual control means for adjusting the sensitivity of said transceiver to changes in the reflected beam.

8. A system according to claim 1 for controlling registration in a printing press wherein said monitoring means further includes reset means coupled to said registering means and said scanner means for initiating operation of said registering means in response to the occurrence of one of said scanner output signals and means coupled to said registering means for successively resetting said registering means at the same point in each cycle of said work station.

9. A system according to claim 8 for controlling registration in a printing press wherein said monitoring means further includes a secondary counter selectively coupled to said pulse generating means and driven by said position pulses, window control means coupled between said registering means and said secondary counter responsive to the achievement of predetermined counts in said registering means for activating and deactivating said secondary counter at selected counts occurring symmetrically around the resetting of said registering means so as to define an observation window, and latch means coupled to said secondary scanner and said scanner means and adapted to be updated to the count in said secondary counter in response to the occurrence of each output signal from said scanner means within said observation window, the count registered in said latch means corresponding to said registration error.

10. A system according to claim 9 for controlling registration in a printing press wherein said secondary counter is preset at the time it is activated and begins counting down from a preset number corresponding to the counts remaining in the cycle of said registering means until it reaches zero and then counts up to said preset number at the beginning of the next cycle of said registering means so that the number to which said latch means is updated by the scanner output pulse varies in sense and magnitude with the actual registration error.

11. A system according to claim 9 for controlling registration in a printing press wherein said window control means comprises a plurality of gates each selectively activated by said registering means for detecting the occurrence of a predetermined count in said registering means and means for responding to at least one of said gates for initiating said observation window.

* * * * *